US011561488B2

(12) United States Patent
Okuno

(10) Patent No.: US 11,561,488 B2
(45) Date of Patent: Jan. 24, 2023

(54) POWDER TRANSPORT DEVICE, POWDER CONTAINER, POWDER SUPPLY DEVICE, AND POWDER UTILIZATION APPARATUS

(71) Applicant: FUJIFILM Business Innovation Corp., Tokyo (JP)

(72) Inventor: Taichiro Okuno, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/392,798

(22) Filed: Aug. 3, 2021

(65) Prior Publication Data

US 2022/0308497 A1 Sep. 29, 2022

(30) Foreign Application Priority Data

Mar. 26, 2021 (JP) ..... JP2021-053531

(51) Int. Cl.
*G03G 15/08* (2006.01)

(52) U.S. Cl.
CPC ..... *G03G 15/0887* (2013.01)

(58) Field of Classification Search
CPC ..... G03G 15/0887
See application file for complete search history.

(56) References Cited

U.S. PATENT DOCUMENTS 8,543,040 B2 9/2013 Suzuki et al.
2009/0252539 A1* 10/2009 Kubota ..... G03G 15/0893 399/262

FOREIGN PATENT DOCUMENTS

JP 08-166710 A 6/1996
JP 4780697 B2 * 9/2011
(Continued)

OTHER PUBLICATIONS

English machine translation of Takayama et al. (JP 2012 058521 A) (Year: 2012).*
(Continued)

*Primary Examiner* — Walter L Lindsay, Jr.
*Assistant Examiner* — Geoffrey T Evans
(74) *Attorney, Agent, or Firm* — Sughrue Mion, PLLC

(57) ABSTRACT

A powder transport device includes a falling passage unit having an inclined surface that is inclined so as to narrow an interior space, through which powder falls, in a lower region of the interior space; a transport passage unit that is connected to a lower end of the falling passage unit and that has a passage space that extends in a direction in which the powder is transported; a transport member that rotates in the passage space of the transport passage unit to transport the powder in one direction, which is a transporting direction; and an elastic sheet that is disposed to cover a portion of the falling passage unit including the inclined surface, the elastic sheet including an upper end portion that is fixed and a lower end that serves as a free end and faces the transport member. The elastic sheet includes a projection that extends and projects from the lower end at a position near an upstream end of the lower end in the transporting direction in which the powder is transported by the transport member. The inclined surface has a protrusion that protrudes such that an upstream edge portion of the elastic sheet in the transporting direction is maintained separated from the inclined surface. A contact body is disposed in the passage space of the transport passage unit, the contact body repeating a movement of coming into contact with the projection to raise a portion of the elastic sheet and then moving away from the projection.

20 Claims, 23 Drawing Sheets

(56) References Cited

FOREIGN PATENT DOCUMENTS

| | | | | |
|---|---|---|---|---|
| JP | 2012058521 | A | * | 3/2012 |
| JP | 5099157 | B2 | | 12/2012 |

OTHER PUBLICATIONS

English machine translation of Hashimoto (JP 4780697 B2) (Year: 2011).*

* cited by examiner

POWDER TRANSPORT DEVICE, POWDER CONTAINER, POWDER SUPPLY DEVICE, AND POWDER UTILIZATION APPARATUS

CROSS-REFERENCE TO RELATED APPLICATIONS

This application is based on and claims priority under 35 USC 119 from Japanese Patent Application No. 2021-053531 filed Mar. 26, 2021.

BACKGROUND

(i) Technical Field

The present disclosure relates to a powder transport device, a powder container, a powder supply device, and a powder utilization apparatus.

(ii) Related Art

Japanese Patent No. 5099157 (see, for example, claim 1, paragraph 0098, and FIG. 1) discloses a developer storage container as well as a developing device, an image forming unit, and an image forming apparatus including the developer storage container. The developer storage container includes a developer storage unit, a transport member, and an elastic member. The transport member is rotatably disposed in the developer storage unit and transports developer in a rotational axis direction. The elastic member is disposed in the developer storage unit such that an upper end portion thereof is fixed and that a lower end portion thereof, which serves as a swingable free end, extends in a transporting direction of the transport member above the transport member. A part of the lower end portion in the transporting direction of the transport member comes into contact with the transport member that rotates at plural upstream and downstream locations in the transporting direction, and is thereby elastically deformed.

According to Japanese Patent No. 5099157, the elastic member of the developer storage container is movable between a position at which the elastic member is deformed due to contact with the transport member and a restored position at which the elastic member is not in contact with the transport member. When the transport member rotates, upstream and downstream portions of the elastic member in the transporting direction of the transport member are elastically deformed due to contact with the transport member, and then return to the restored position at different times.

SUMMARY

Aspects of non-limiting embodiments of the present disclosure relate to a powder transport device, a powder container, a powder supply device, and a powder utilization apparatus capable of moving and loosening powder before the powder falls into a transport passage unit and moving the loosened powder in a direction in which the powder is transported in the transport passage unit. The transport passage unit is connected to a lower end of a falling passage unit having an inclined surface inclined so as to narrow an interior space of the falling passage unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder transport device including a falling passage unit having an inclined surface that is inclined so as to narrow an interior space, through which powder falls, in a lower region of the interior space; a transport passage unit that is connected to a lower end of the falling passage unit and that has a passage space that extends in a direction in which the powder is transported; a transport member that rotates in the passage space of the transport passage unit to transport the powder in one direction, which is a transporting direction; and an elastic sheet that is disposed to cover a portion of the falling passage unit including the inclined surface, the elastic sheet including an upper end portion that is fixed and a lower end that serves as a free end and faces the transport member. The elastic sheet includes a projection that extends and projects from the lower end at a position near an upstream end of the lower end in the transporting direction in which the powder is transported by the transport member. The inclined surface has a protrusion that protrudes such that an upstream edge portion of the elastic sheet in the transporting direction is maintained separated from the inclined surface. A contact body is disposed in the passage space of the transport passage unit, the contact body repeating a movement of coming into contact with the projection to raise a portion of the elastic sheet and then moving away from the projection.

BRIEF DESCRIPTION OF THE DRAWINGS

Exemplary embodiments of the present disclosure will be described in detail based on the following figures, wherein.

DETAILED DESCRIPTION

Exemplary embodiments for carrying out the present disclosure (referred to simply as "exemplary embodiments" in this specification) will now be described with reference to the drawings.

First Exemplary Embodiment

Figure 1A:
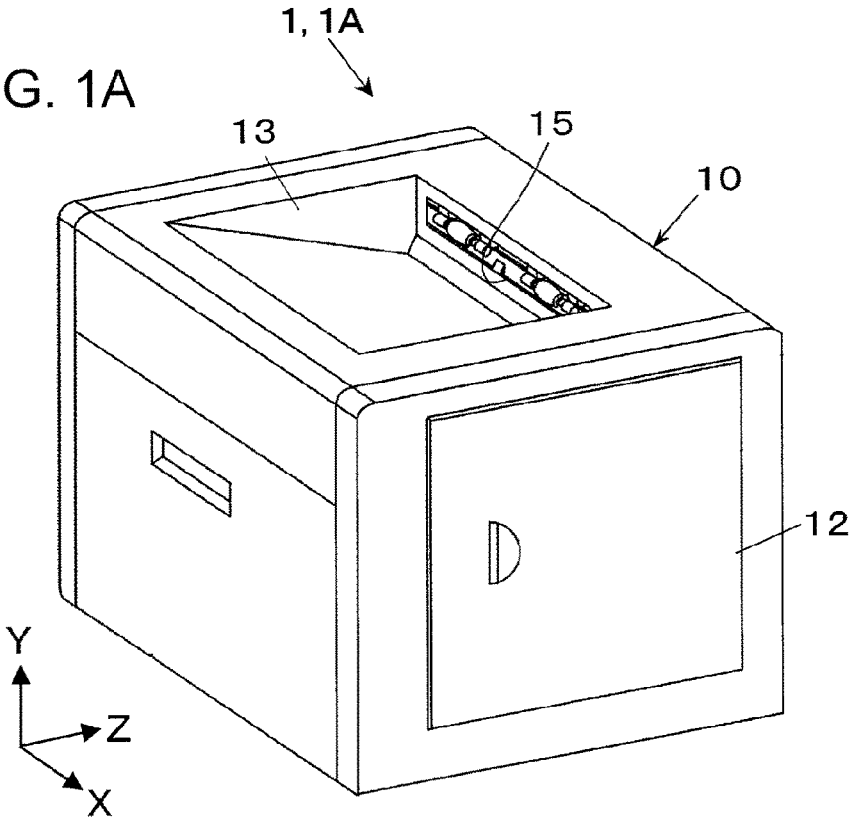
FIG. 1A is a perspective view illustrating the appearance of an image forming apparatus according to a first exemplary embodiment.
Figure 1B:
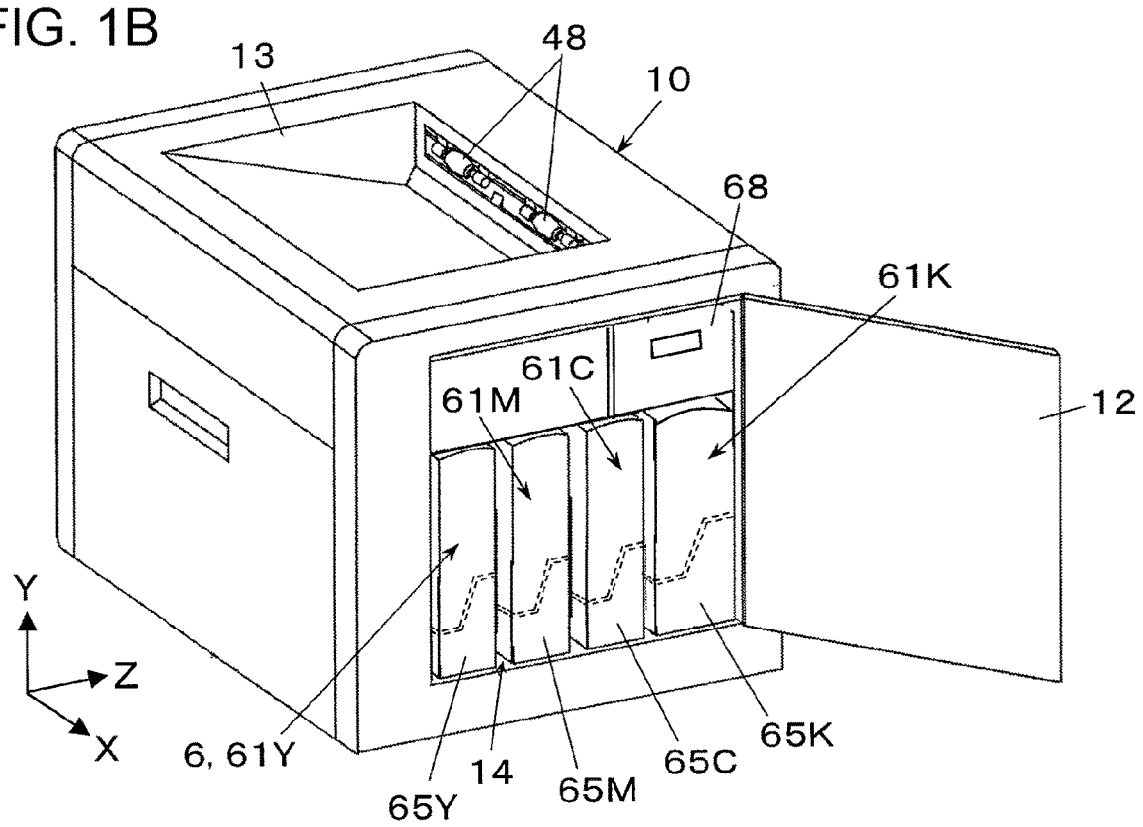
FIG. 1B is a perspective view of the image forming apparatus illustrated in FIG. 1A in a state in which a side covering is open.
Figure 2:
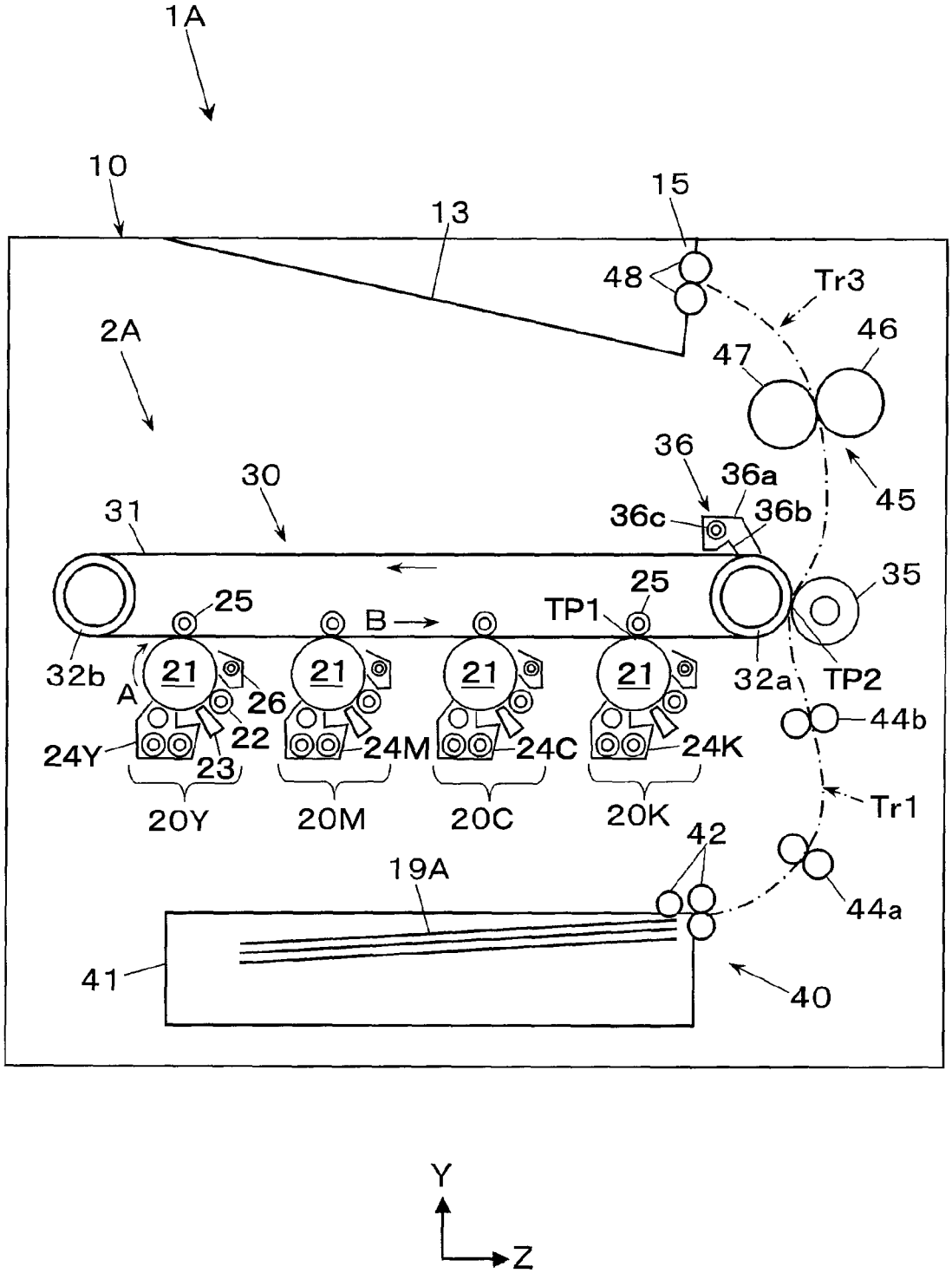
FIG. 2 is a schematic diagram illustrating the internal structure of the image forming apparatus illustrated in FIGS. 1A and 1B.

FIGS. 1A, 1B, and FIG. 2 illustrate an image forming apparatus 1A as an example of a powder utilization apparatus 1 according to a first exemplary embodiment. FIGS. 1A and 1B illustrate the appearance of the image forming apparatus 1A, and FIG. 2 illustrates the internal structure of the image forming apparatus 1A.

In the following description, the direction shown by arrow X in the drawings is defined as the width direction in front view of the image forming apparatus 1A, the direction shown by arrow Y as the height direction in front view of the image forming apparatus 1A, and the direction shown by arrow Z as the depth direction that is orthogonal to both the width direction and the height direction and that extends from front to back of the image forming apparatus 1A.

As illustrated in, for example, FIGS. 1A, 1B, and 2, the image forming apparatus 1A is an apparatus that forms an image made of developer 18A (see FIG. 3), which is an example of powder 18, on a recording sheet 19A, which is an example of a sheet-shaped object 19. The developer may be, for example, two-component developer containing non-magnetic toner and magnetic carrier.

The image forming apparatus 1A according to the first exemplary embodiment is configured as a printer having a function of forming an image corresponding to image information input from an external device, such as an information terminal or a personal computer, on the recording sheet 19A. The image information is, for example, information relating to images including texts, graphics, pictures, and patterns.

The image forming apparatus 1A includes developer containers 61, which are examples of a powder container 6 and in which the developer 18A is stored; an image forming unit 2A, which is an example of a powder consuming device 2 and which receives and consumes the developer 18A stored in the developer containers 61; and a housing 10 to which the developer containers 61 and other components are removably attached and that houses the image forming unit 2A and other components.

The housing 10 is a structure formed to have, for example, a box-shaped appearance by combining materials including support frames and external panels.

The housing 10 includes a side covering 12 that opens and closes on a side thereof. The housing 10 also includes an output receiver 13 at the top thereof, the output receiver 13 receiving the recording sheet 19A that is output after an image is formed thereon. The housing 10 also includes a container attachment unit 14, which is a structural part to which the developer containers 61 and collection containers 65 described below are removably attached, at a location accessible when the side covering 12 is opened.

As illustrated in FIG. 2, the image forming unit 2A includes image forming devices 20, an intermediate transfer device 30, a sheet supplying device 40, and a fixing device 45. The image forming devices 20 form visible images based on the image information. The intermediate transfer device 30 temporarily holds the visible images formed by the image forming devices 20 and transfers the visible images onto the recording sheet 19A in a second transfer process. The sheet supplying device 40 contains the recording sheet 19A to be supplied to a second transfer position of the intermediate transfer device 30 and supplies the recording sheet 19A. The fixing device 45 fixes the visible images transferred by the intermediate transfer device 30 in the second transfer process to the recording sheet 19A. The image forming unit 2A is an intermediate-transfer image forming unit that uses the intermediate transfer device 30.

The image forming devices 20 include four image forming devices 20Y, 20M, 20C, and 20K dedicated to form visible toner images of four colors, which are yellow (Y), magenta (M), cyan (C), and black (K), respectively, by, for example, an electrophotographic method.

Figure 3:
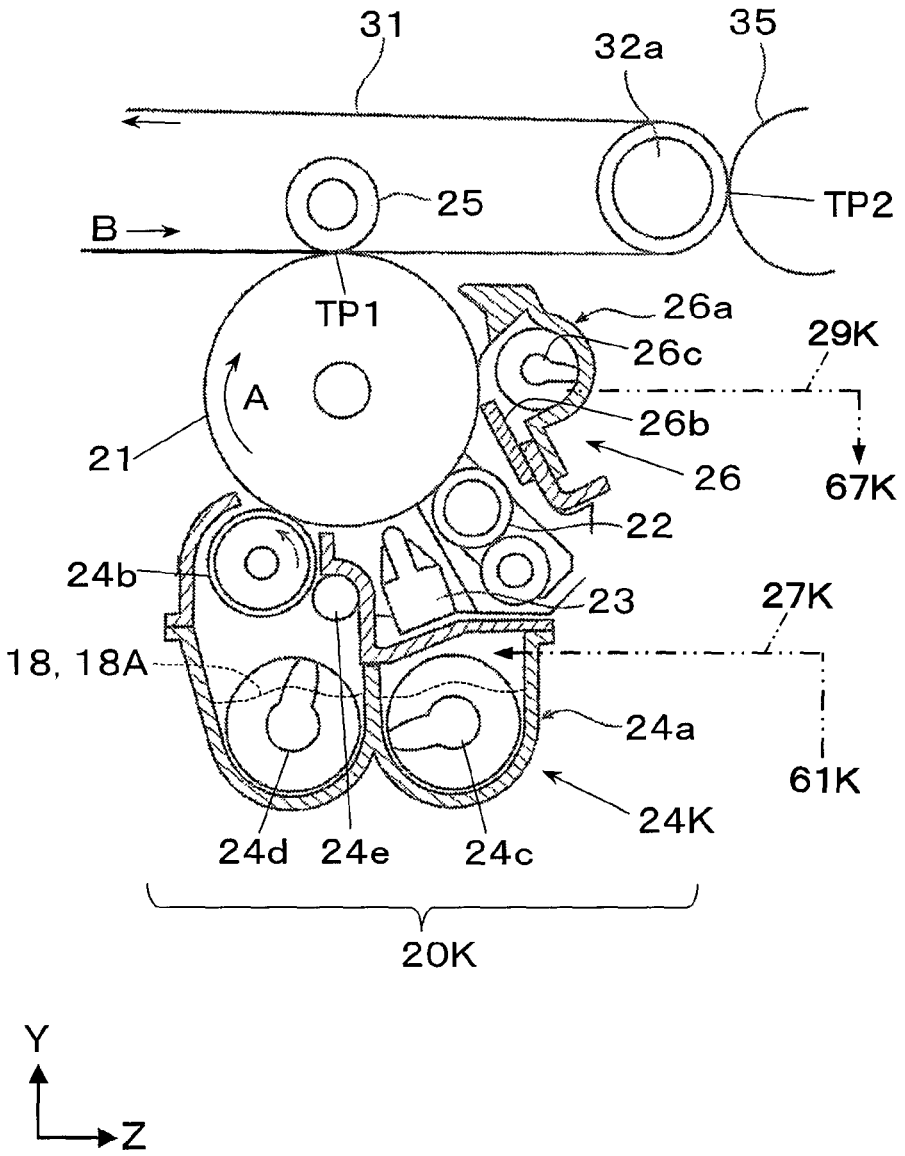
FIG. 3 is a schematic diagram illustrating the structure of an image forming device and other components included in the image forming apparatus illustrated in FIG. 2.

As illustrated in FIGS. 2 and 3, each of the four image forming devices 20Y, 20M, 20C, and 20K includes a drum-shaped photoconductor 21, which is an example of an image carrier that rotates in the direction of arrow A and carries a latent image or a visible image.

Each of the image forming devices 20Y, 20M, 20C, and 20K also includes devices arranged around the photoconductor 21, the devices including a charging device 22, an exposure device 23, a developing device 24Y, 24M, 24C, or 24K, a first transfer device 25, and a first cleaning device 26. The charging device 22 charges the outer peripheral surface of the photoconductor 21 to a predetermined potential. The exposure device 23 forms an electrostatic latent image by exposing the charged outer peripheral surface of the photoconductor 21 to light. The developing device 24Y, 24M, 24C, or 24K develops the electrostatic latent image into a visible toner image with the developer 18A (toner in practice). The first transfer device 25 transfers the toner image onto the intermediate transfer device 30. The first cleaning device 26 cleans the outer peripheral surface of the photoconductor 21.

In FIG. 2, reference numerals from 21 to 26 are shown for all of the respective components of the image forming device 20Y for yellow (Y), but are shown for only some of the respective components of the image forming devices 20M, 20C, and 20K for other colors. In FIG. 3, the black image forming device 20K is illustrated as a representative example.

As illustrated in FIG. 2, the intermediate transfer device 30 includes an intermediate transfer belt 31, which is an example of an intermediate transfer body that carries the toner images transferred thereto from the photoconductors 21 of the image forming devices 20Y, 20M, 20C, and 20K in the first transfer process. The intermediate transfer belt 31 is an endless belt capable of electrostatically carrying the toner images, and is supported by plural support rollers 32 (for example, two support rollers 32*a* and 32*b*) disposed inside the intermediate transfer belt 31 so that the intermediate transfer belt 31 rotates in the direction of arrow B while successively passing through first transfer positions TP1 of the image forming devices 20Y, 20M, 20C, and 20K.

The intermediate transfer device 30 includes devices including a second transfer device 35 and a second cleaning device 36 arranged around the intermediate transfer belt 31. The second transfer device 35 transfers the toner images that have been transferred to the intermediate transfer belt 31 in the first transfer process to the recording sheet 19A in the second transfer process. The second cleaning device 36 cleans the outer peripheral surface of the intermediate transfer belt 31.

When the image forming devices 20Y, 20M, 20C, and 20K receive a command to execute an image forming operation from the external device, for example, through a control device (not illustrated), each photoconductor 21 that rotates in the direction of arrow A is successively subjected to a charging operation performed by the charging device 22, an exposure operation performed by the exposure device 23, and a developing operation performed by a corresponding one of the developing devices 24Y, 24M, 24C, and 24K. Thus, a toner image of one of the four colors (Y, M, C, and K) is formed on the outer peripheral surface of each photoconductor 21. For example, a yellow (Y) toner image is formed on the outer peripheral surface of the photoconductor 21 of the image forming device 20Y, and a magenta (M) toner image is formed on the outer peripheral surface of the photoconductor 21 of the image forming device 20M.

The image forming devices 20Y, 20M, 20C, and 20K and the intermediate transfer device 30 operate so that each first transfer device 25 performs a transferring operation on the intermediate transfer belt 31, which rotates in the direction of arrow B, at the corresponding first transfer position TP1 at which the first transfer device 25 faces the intermediate transfer belt 31. Thus, the toner image formed on each photoconductor 21 is transferred to the intermediate transfer belt 31 at a predetermined timing in the first transfer process. After the first transfer process, each first cleaning device 26 cleans the outer peripheral surface of the corresponding photoconductor 21 by removing unnecessary substances, such as toner, that remain on the outer peripheral surface.

In addition, the intermediate transfer device 30 operates so that the second transfer device 35 performs a transferring operation at a second transfer position TP2 at which the second transfer device 35 faces the intermediate transfer belt 31. Thus, the toner images that have been transferred to the intermediate transfer belt 31 in the first transfer process are simultaneously transferred to one side of the recording sheet 19A supplied from the sheet supplying device 40 in the second transfer process. After the second transfer process, the second cleaning device 36 cleans the outer peripheral surface of the intermediate transfer belt 31 by removing unnecessary substances, such as toner, that remain on the outer peripheral surface.

The sheet supplying device 40 is a device configured to contain the recording sheet 19A to be supplied to the second transfer position TP2 and supply the recording sheet 19A to the second transfer position TP2. The sheet supplying device 40 includes, for example, a container 41 that contains a stack of recording sheets 19A and that is capable of being pulled out of the housing 10, and a feeding device 42 that feeds the recording sheets 19A contained in the container 41 one at a time.

The feeding device 42 of the sheet supplying device 40 is activated to feed the recording sheets 19A from the container 41 one at a time at a predetermined timing, for example, in the image forming operation.

Referring to FIG. 2, each recording sheet 19A fed from the sheet supplying device 40 is transported to the second transfer position TP2 of the intermediate transfer device 30 along a supply transport path Tr1 defined by, for example, pairs of transport rollers 44*a* and 44*b* and a guide member (not illustrated). The recording sheet 19A may be any sheet-shaped recording medium, such as plain paper, coated paper, cardboard paper, or an envelope, as long as the recording medium is transportable in the housing 10 and toner images may be transferred and fixed thereto. The material, form, etc., of the recording sheet 19A are not particularly limited.

The fixing device 45 includes a housing (not illustrated) having an inlet and an outlet for the recording sheet 19A and components disposed in an interior space of the housing, the components including a heating rotating body 46 of, for example, a roller-type or a belt-nip-type having heating means (not illustrated), and a pressing rotating body 47 of, for example, a roller-type.

The fixing device 45 is activated at a predetermined timing, for example, in the image forming operation, so that the heating rotating body 46 is heated to a fixing temperature and that the heating rotating body 46 and the pressing rotating body 47 rotate in a predetermined direction while being pressed against each other to form a nip portion. The recording sheet 19A that is fed from the second transfer position TP2 and to which toner images have been transferred in the second transfer process is introduced into and passed through the nip portion. Thus, the toner images on the recording sheet 19A are subjected to a fixing process in which heat and pressure are applied thereto in the nip portion, and are thereby melted and fixed to one side of the recording sheet 19A.

Referring to FIG. 2, the recording sheet 19A that has been subjected to the fixing operation performed by the fixing device 45 is transported along an output transport path Tr3 defined by, for example, a pair of output rollers 48 and a guide member (not illustrated) disposed inside and in front of the output hole 15, and then output through the output hole 15 and received by the output receiver 13.

Thus, the image forming operation performed by the image forming apparatus 1A on one side of the recording sheet 19A is completed.

The image forming apparatus 1A is capable of selectively performing different types of image forming operations. Typical examples of the image forming operations include an operation of forming a multicolor image, which is a combination of toner images of four colors (Y, M, C, and K) obtained by activating all of the four image forming devices 20Y, 20M, 20C, and 20K, and an operation of forming a monochrome image, such as a black image, that is a toner image of a single color obtained by activating one of the four image forming devices 20Y, 20M, 20C, and 20K.

Supply of Developer

When the developing devices 24Y, 24M, 24C, and 24K of the image forming apparatus 1A perform the developing operation, the developer 18A, that is, toner 18At (see FIG. 9) in practice, is consumed and the amount thereof is reduced. Accordingly, an amount of toner 18At that substantially corresponds to the amount of reduction needs to be supplied. Therefore, as conceptually illustrated in FIG. 5, the image forming apparatus 1A includes a developer supply device 7A, which is an example of a powder supply device 7.

Figure 5:
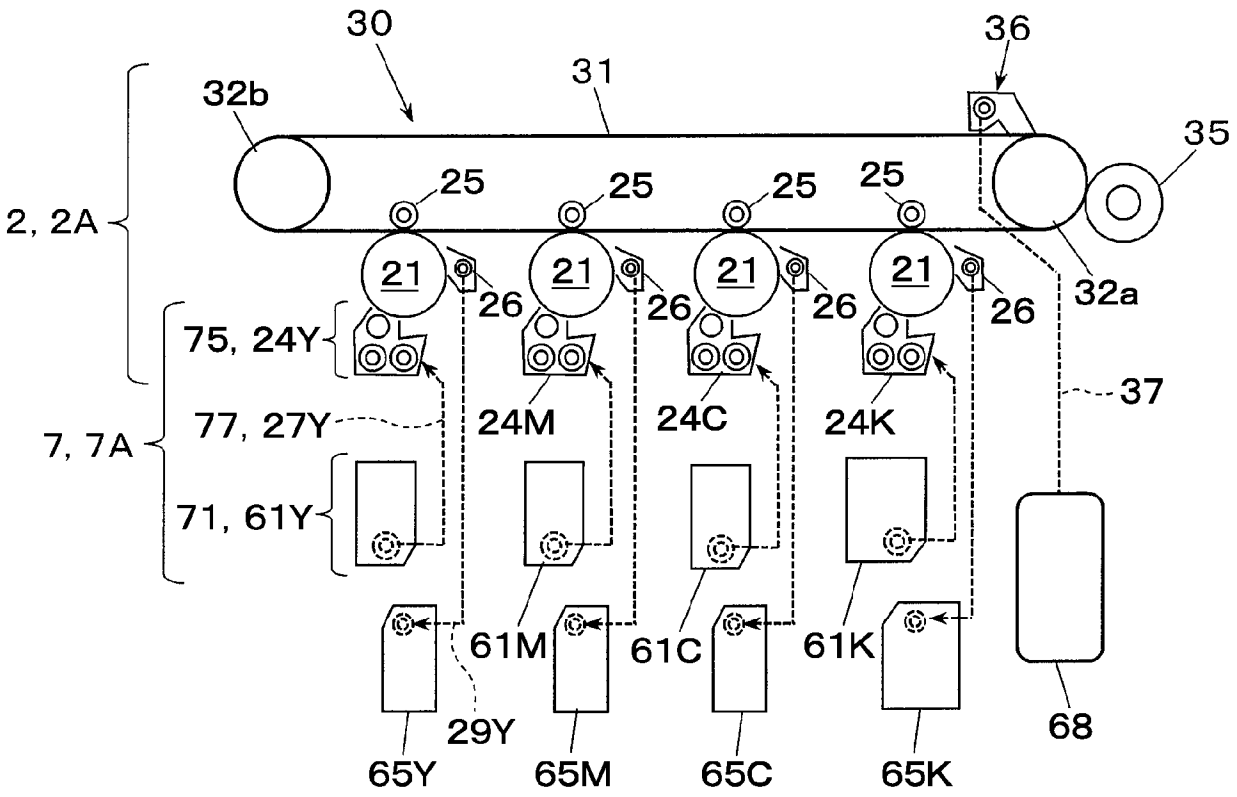
FIG. 5 is a schematic diagram illustrating the structures of developer supply devices and collecting devices included in the image forming apparatus illustrated in FIGS. 1A and 1B.

As illustrated in FIG. 5, the developer supply device 7A includes the developer containers 61Y, 61M, 61C, and 61K, which are examples of the powder container 6 or examples of a storage unit 71 and which contain the toner 18At of the developer 18A; the developing devices 24Y, 24M, 24C, and 24K, which are examples of a receiving unit 75 and which receive the toner 18At of the developer 18A stored in the developer containers 61Y, 61M, 61C, and 61K, respectively; and supply paths 27Y, 27M, 27C, and 27K, which are examples of a supply transport unit 77 and which transport the toner 18At of the developer 18A stored in the developer containers 61Y, 61M, 61C, and 61K to supply the toner 18At of the developer 18A to the developing devices 24Y, 24M, 24C, and 24K, respectively.

When it is required to supply the toner 18At, the developer supply device 7A operates so that the toner 18At of the developer 18A stored in each of the developer containers 61Y, 61M, 61C, and 61K is transported along the corresponding one of the supply paths 27Y, 27M, 27C, and 27K and supplied to the corresponding one of the developing devices 24Y, 24M, 24C, and 24K.

The developer containers 61Y, 61M, 61C, and 61K, which are examples of the storage unit 71, each contain the toner 18At of the developer 18A of the corresponding one of the four colors (Y, M, C, and K). Transport members 64 and 67 (described below) that transport the toner 18At are disposed in each of the developer containers 61Y, 61M, 61C, and 61K.

The developer containers 61Y, 61M, 61C, and 61K will be described in detail below.

The developing devices 24Y, 24M, 24C, and 24K, which are examples of the receiving unit 75, differ only in that the colors of the toner 18At of the developer 18A used therein are different ones of the four colors (Y, M, C, and K), and the structures thereof are the same in other respects.

More specifically, referring to FIG. 3, which illustrates the developing device 24K as a representative example of the developing devices 24Y, 24M, 24C, and 24K, each of the developing devices 24Y, 24M, 24C, and 24K includes a container-shaped housing 24*a* that has a developer storage chamber and a developer opening and in which components including a developing roller 24*b*, stirring-and-transporting members 24*c* and 24*d*, and an adjustment member 24*e* are disposed. The developing roller 24*b* holds the developer 18A and supplies the developer 18A to a developing region of the photoconductor 21 that faces the developer opening. The stirring-and-transporting members 24*c* and 24*d* are, for example, screw augers that transport the developer 18A contained in the developer storage chamber of the housing 24*a* while stirring the developer 18A. The adjustment member 24*e* adjusts the amount of developer 18A held by the developing roller 24*b*, more specifically, for example, the thickness of the layer of the developer 18A that is held.

The supply paths 27Y, 27M, 27C, and 27K, which are examples of the supply transport unit 77, are structural parts having transport passages through which the toner 18At to be supplied is transported. As shown by the two-dot chain lines in FIG. 8, each of the supply paths 27Y, 27M, 27C, and 27K is a cylindrical structure formed on one side of the housing 24*a* of the corresponding one of the developing devices 24Y, 24M, 24C, and 24K by extending one end of the stirring-and-transporting member 24*c* in a direction toward the container attachment unit 14. The portion extended from the stirring-and-transporting member 24*c* may have any structure that matches the supply path 27, and the structure thereof is not particularly limited. In addition, the portion extended from the stirring-and-transporting member 24*c* is rotated in synchronization with the operation of the stirring-and-transporting member 24*c*.

Figure 4:
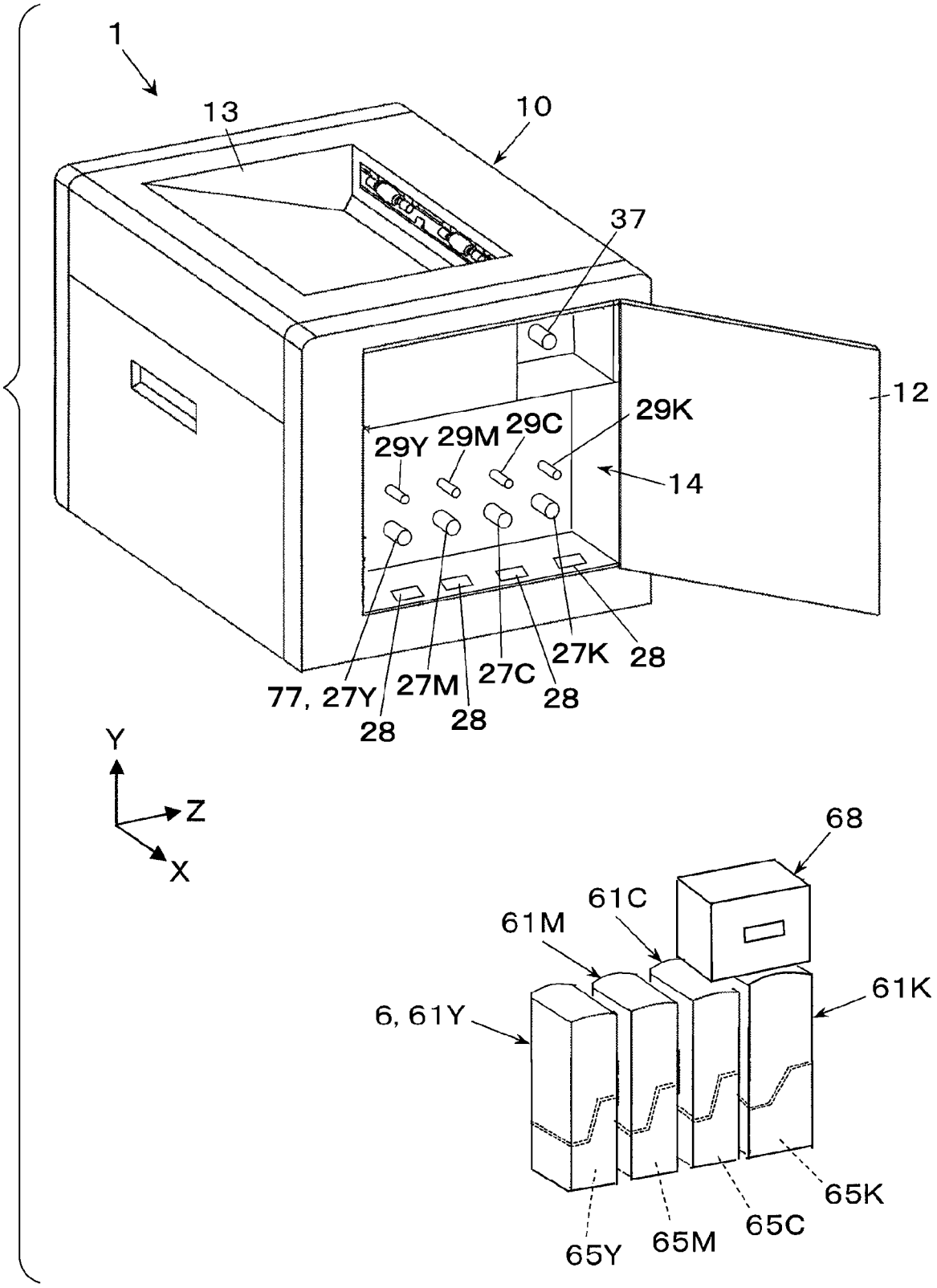
FIG. 4 is a perspective view of the image forming apparatus illustrated in FIGS. 1A and 1B and removable containers removed therefrom.
Figure 8:
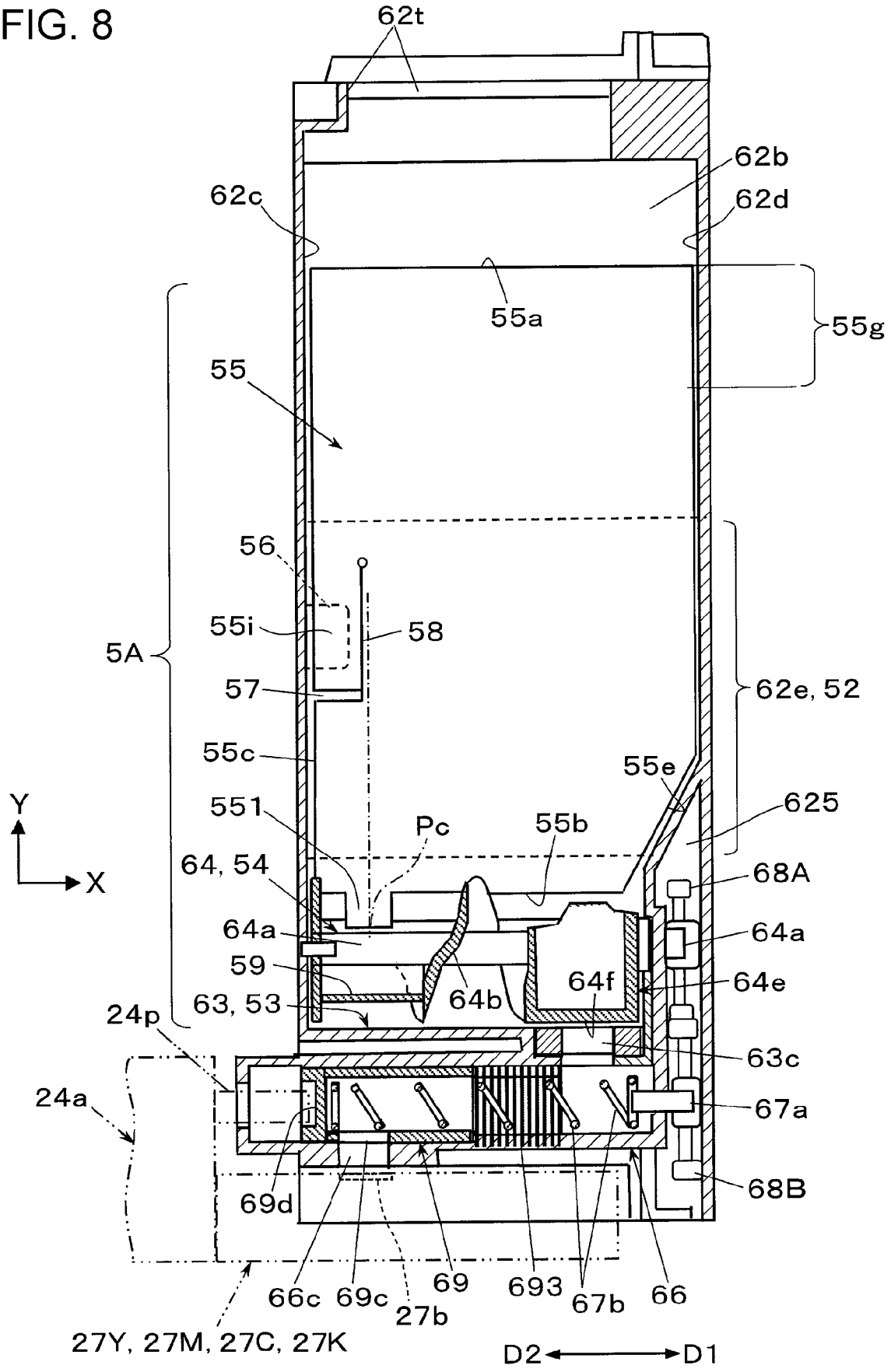
FIG. 8 is a schematic diagram of a portion of the developer container illustrated in FIG. 7 behind a cross-section taken along line VIII-VIII.

When the developing devices 24Y, 24M, 24C, and 24K are installed in the housing 10 at attachment positions thereof, the supply paths 27Y, 27M, 27C, and 27K project outward, as illustrated in FIG. 4, through communicating portions (not illustrated) provided in the container attachment unit 14. As illustrated in FIG. 8, a projecting end portion of each of the supply paths 27Y, 27M, 27C, and 27K has a receiving hole 27*b* through which the supplied toner 18At is received and an openable lid (not illustrated) that covers and uncovers the receiving hole 27*b*.

As illustrated in FIG. 4, the container attachment unit 14 to which the developer containers 61Y, 61M, 61C, and 61K are attached is provided with driving-force-transmitting units 28 that transmit rotating power to the transport members 64 and 67 (described below) disposed in each of the developer containers 61Y, 61M, 61C, and 61K.

The driving-force-transmitting units 28 include driving gears (not illustrated) for providing connection. The driving gears receive rotating power from a rotational driving device (not illustrated) disposed in the housing 10 of the image forming apparatus 1A, and transmit the received rotating power. The rotational driving device is rotated for a predetermined time when detection information is supplied from a detection unit (not illustrated) that detects a situation in which it is required to supply the toner 18At in the image forming apparatus 1A.

Thus, a predetermined amount of the toner 18At stored in each of the developer containers 61Y, 61M, 61C, and 61K is fed to the corresponding one of the supply paths 27Y, 27M, 27C, and 27K by the transport members 64 and 67 that are rotated for the predetermined time.

Developer Containers

The developer containers 61Y, 61M, 61C, and 61K are examples of the powder container 6, and each include a container body 60 and a developer transport device 5A as illustrated in, for example, FIGS. 6 to 10. The container body 60 contains the toner 18At of the developer 18A. The developer transport device 5A is an example of a powder transport device 5 that transports the toner 18At stored in the container body 60 by causing the toner 18At to fall in the container body 60.

Figure 6:
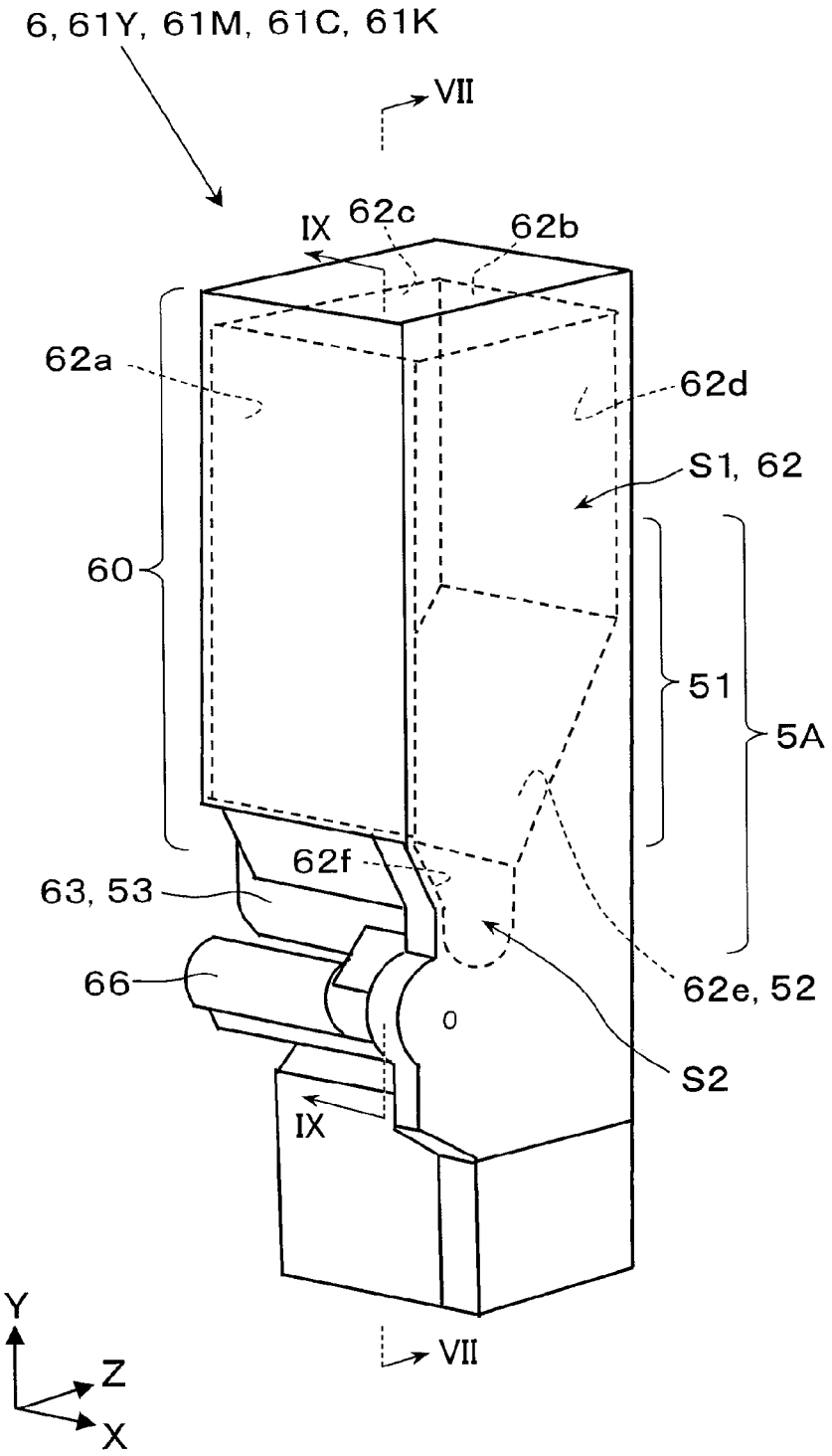
FIG. 6 is a schematic perspective view illustrating the appearance of a developer container.

As illustrated in FIG. 6, the above-described container body 60 has, for example, a substantially rectangular parallelepiped shaped appearance and extends in the vertical direction. As illustrated in, for example, FIGS. 6 and 7, the container body 60 has a storage space unit 62, a transport unit 63, and a delivery unit 66 disposed therein. The storage space unit 62 has an interior space S1 in which the toner 18At of the developer 18A is stored. The transport unit 63 and the delivery unit 66 are disposed below and connected to the storage space unit 62.

The storage space unit 62 of the container body 60 is a structural part in which the toner 18At is contained and stored.

As illustrated in FIGS. 6 to 10, the storage space unit 62 has a space therein that is surrounded by four vertical surfaces 62*a*, 62*b*, 62*c*, and 62*d* that are substantially orthogonal to each other and extend substantially vertically; a first inclined surface 62*e* provided below the vertical surface 62*b* and inclined so as to narrow the interior space S1; and a second inclined surface 62*f* provided below the vertical surface 62*a* that faces the vertical surface 62*b* and inclined so as to narrow the interior space S1.

Figure 7:
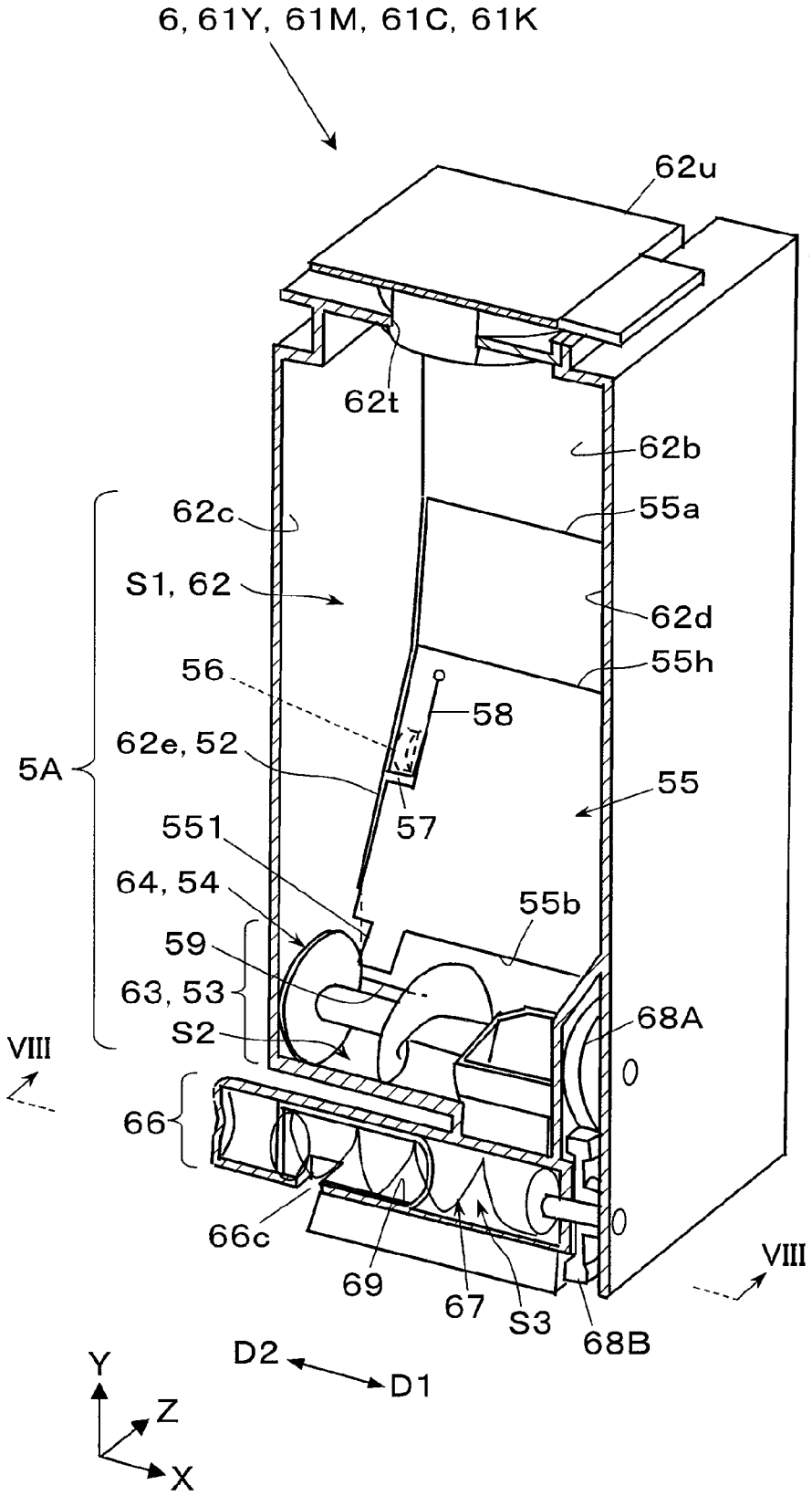
FIG. 7 is a schematic perspective view of a portion of the developer container illustrated in FIG. 6 behind a cross-section taken along line VII-VII.
Figure 9:
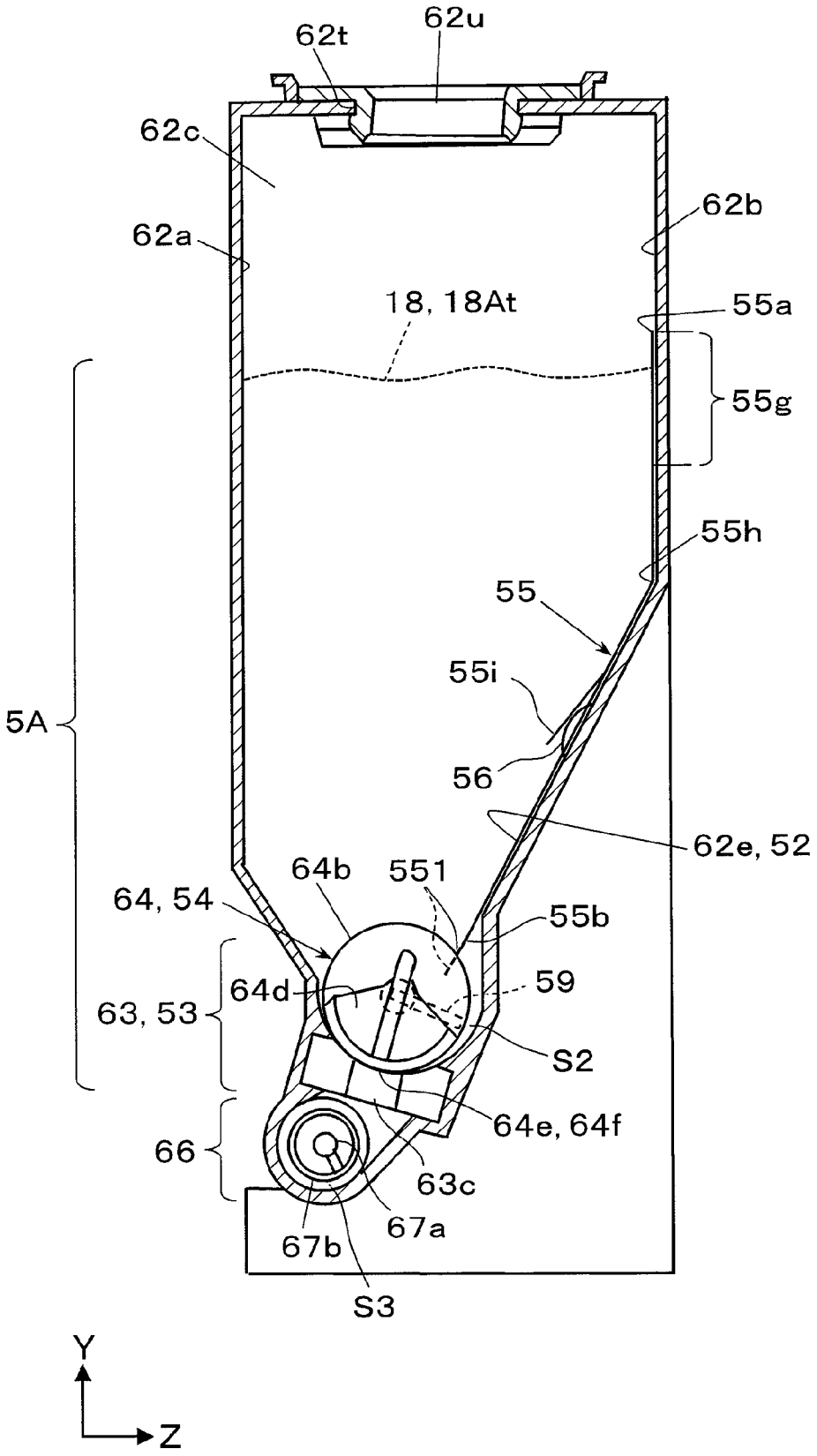
FIG. 9 is a schematic diagram of a portion of the developer container illustrated in FIG. 6 behind a cross-section taken along line IX-IX.

As illustrated in FIGS. 7 and 9, the storage space unit 62 has a ceiling surface having an opening 62*t* at the upper end thereof. The opening 62*t* is basically used when the toner 18At is introduced, and is covered with a lid body 62*u* when not used.

When the toner 18At is being supplied, the toner 18At stored in the storage space unit 62 falls downward into the transport unit 63 basically due to gravity.

The transport unit 63 of the container body 60 is a structural part that is connected to the lower end of the storage space unit 62 and extends in a direction in which the toner 18At of the developer 18A is transported.

As illustrated in, for example, FIGS. 6, 8, and 9, the transport unit 63 projects downward from both the lower end of the first inclined surface 62*e* and the lower end of the second inclined surface 62*f* to from a U-shaped cross-section, and has a groove-shaped passage space S2 formed therein to extend straight from the vertical surface 62*c* toward the vertical surface 62*d*. The transport unit 63 has a feed port 63*c* through which the toner 18At is fed to the delivery unit 66 at the bottom of an end portion of the transport unit 63 adjacent to the vertical surface 62*d*.

As illustrated in FIGS. 7 to 9, the transport member 64 is disposed in the transport unit 63. The transport member 64 rotates in the passage space S2 to transport the toner 18At in one direction, which is a transporting direction D1.

The transport member 64 may be, for example, a screw auger including a rotating shaft 64*a* and a transporting projection 64*b* that helically projects and extends along an outer peripheral surface of the rotating shaft 64*a*. The transport member 64 is rotated about the rotating shaft 64*a* in a predetermined direction so that the toner 18At that has fallen into the transport unit 63 from the storage space unit 62 is moved by the transporting projection 64*b* in the transporting direction D1 and fed through the feed port 63*c*. The transporting direction D1 in which the toner 18At is transported by the transport member 64 may be regarded as a direction along a longitudinal direction (axial direction) of the rotating shaft 64*a*.

Figure 11:
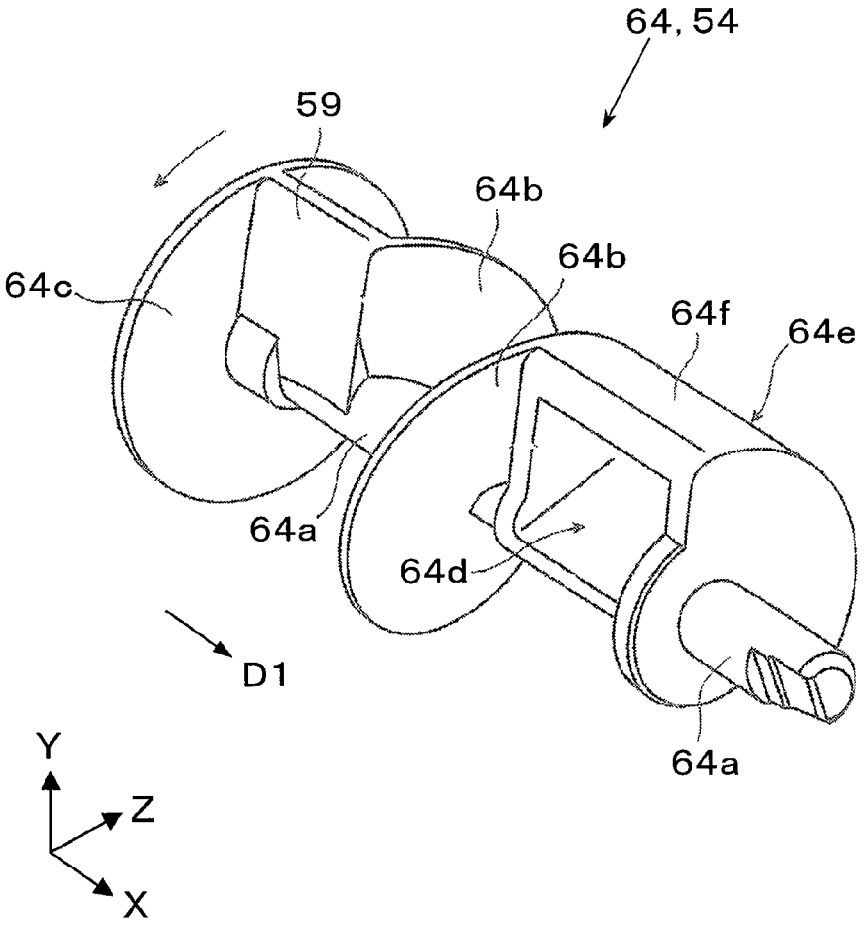
FIG. 11 is a perspective view of a transport member of a transport unit included in the developer container illustrated in FIG. 7.

As illustrated in, for example, FIG. 11, the transport member 64 includes a disc-shaped support portion 64*c* at an upstream end of the rotating shaft 64*a* in the transporting direction D1 and a bucket-shaped feeding portion 64*e* at a downstream end of the rotating shaft 64*a* in the transporting direction D1.

The feeding portion 64*e* is a structural part having a recess 64*d* and an outer peripheral surface 64*f*. The recess 64*d* scoops and temporarily holds the toner 18At that is transported and moved through the passage space S2 of the transport unit 63, and then feeds the toner 18At through the feed port 63*c* when the recess 64*d* passes the feed port 63*c* as the transport member 64 rotates. The outer peripheral surface 64*f* is a cylindrical outer peripheral surface that defines the bottom surface of the recess 64*d* and that is arc-shaped in cross-section with the rotating shaft 64*a* at the center. The outer peripheral surface 64*f* has a function of temporarily blocking the feed port 63*c* when the outer peripheral surface 64*f* passes the feed port 63*c* as the transport member 64 rotates, thereby temporarily preventing the toner 18At from being fed or leaking through the feed port 63*c*.

The delivery unit 66 of the container body 60 is a structural part provided to deliver the toner 18At fed from the transport unit 63 to the corresponding one of the supply paths 27Y, 27M, 27C, and 27K.

The delivery unit 66 is a cylindrical structural part that is disposed to extend substantially parallel to the transport unit 63 below the transport unit 63 with the feed port 63*c* connected thereto, and has a cylindrical passage space S3 formed therein to extend from the vertical surface 62*d* toward the vertical surface 62*c*. The delivery unit 66 has a discharge hole 66*c* through which the toner 18At is discharged at the bottom of an end portion of the delivery unit 66 adjacent to the vertical surface 62*b*.

As illustrated in FIGS. 7 to 9, the transport member 67 is disposed in the delivery unit 66. The transport member 67 rotates in the passage space S3 to transport the toner 18At in a delivery direction D2, which is opposite to the transporting direction D1.

The transport member 67 may be, for example, an agitator including a rotating shaft portion 67*a* disposed at one end and a helical wire portion 67*b* attached to the rotating shaft portion 67*a*. The transport member 67 is rotated about the rotating shaft portion 67*a* in a predetermined direction, so that the wire portion 67*b* moves the toner 18At fed into the delivery unit 66 through the feed port 63*c* of the transport unit 63 in the delivery direction D2 and discharges the toner 18At through the discharge hole 66*c*.

As illustrated in, for example, FIG. 8, the delivery unit 66 is provided with a movable shutter 69 that covers and uncovers the discharge hole 66*c*.

The movable shutter 69 includes a cylindrical body that is open at one end and that is movably disposed in the passage space S3 of the delivery unit 66. The movable shutter 69 has an opening 69*c* at the bottom of the body thereof, the opening 69*c* being positioned to be capable of facing the discharge hole 66*c*. A recess 69*d* is formed in an outer surface of a closed end of the body. The recess 69*d* is a portion against which a pressing portion 24*p* that projects from a side surface of the housing 24*a* of the corresponding one of the developing devices 24Y, 24M, 24C, and 24K is pressed when the developer container 61 is attached to the container attachment unit 14.

The movable shutter 69 is continuously pressed and biased in the direction of arrow D2 by spring force applied by a spring 693 in the passage space S3 of the delivery unit 66.

While the developer containers 61Y, 61M, 61C, and 61K are not attached to the container attachment unit 14, the movable shutter 69 is continuously pressed and biased in the direction of arrow D2 by the spring force applied by the spring 693 in the space of the delivery unit 66. Accordingly, the body of the movable shutter 69 is positioned to face the discharge hole 66*c* in the delivery unit 66, so that the discharge hole 66*c* in the delivery unit 66 is covered.

As illustrated in FIG. 8, when each of the developer containers 61Y, 61M, 61C, and 61K are attached to the container attachment unit 14, the pressing portion 24*p* of the corresponding one of the developing devices 24Y, 24M, 24C, and 24K comes into contact with and pushes the recess 69*d* in the direction of arrow D1, so that the movable shutter 69 is moved in the direction of arrow D1 in the space in the delivery unit 66. Accordingly, the opening 69*c* in the movable shutter 69 is moved and positioned to face the discharge hole 66*c* in the delivery unit 66, so that the discharge hole 66*c* in the delivery unit 66 is uncovered.

As illustrated in FIGS. 7 and 8, the transport member 64 and the transport member 67 are rotated by rotating power transmitted thereto from transmission gears 68A and 68B attached to the rotating shaft 64*a* and the rotating shaft portion 67*a*, respectively. The transmission gear 68B meshes with the transmission gear 68A. When the developer container 61 is attached to the container attachment unit 14, the transmission gear 68B is connected to the driving gear (not illustrated) of the corresponding one of the driving-force-transmitting units 28 provided in the container attachment unit 14 by meshing with the driving gear directly or through a gear train (not illustrated). Thus, the rotating power is transmitted.

Developer Transport Device

Referring to FIGS. 7 to 9, the developer transport device 5A includes a falling passage unit 51, a transport passage unit 53, a transport member 54, and an elastic sheet 55. The falling passage unit 51 has an inclined surface 52 that is inclined so as to narrow the interior space S1, through which the toner 18At falls, in a lower region of the interior space S1. The transport passage unit 53 is connected to the lower end of the falling passage unit 51 and has the passage space S2 that extends in the transporting direction D1 in which the toner 18At is transported. The transport member 54 rotates in the passage space S2 of the transport passage unit 53 to transport the toner 18At in one direction, which is the transporting direction D1. The elastic sheet 55 is disposed to cover a portion including the inclined surface 52.

The developer transport device 5A also includes the delivery unit 66 and the transport member 67.

The above-described falling passage unit 51 of the developer transport device 5A is at least a portion of the storage space unit 62 of the container body 60, the portion including the first inclined surface 62*e* and a region around the first inclined surface 62*e*. The above-described inclined surface 52 is the first inclined surface 62*e* of the storage space unit 62. The above-described transport passage unit 53 is the transport unit 63 of the container body 60. The above-described transport member 54 is the transport member 64 disposed in the transport unit 63 of the container body 60. The interior space S1 also serves as a storage space in which powder is stored.

The above-described elastic sheet 55 is a shape-retaining sheet-shaped member that is deformed and bent when an external force is applied thereto, that elastically returns to its original shape when the external force is removed, and that retains its shape when no external force is applied. The elastic sheet 55 according to the first exemplary embodiment may be, for example, a substantially elongated rectangular sheet made of synthetic resin, such as polyethylene terephthalate, and having a thickness of about 100 μm to about 200 μm.

As illustrated in FIGS. 7 to 9, a certain portion 55*g* of the elastic sheet 55 including an upper end 55*a* of the elastic sheet 55 is fixed to an upper portion of the vertical surface 62*b* that defines the falling passage unit 51, and a lower end 55*b* of the elastic sheet 55 is a free end and is disposed to face the transport member 54 in the transport passage unit 53.

The portion 55*g* of the elastic sheet 55 including the upper end 55*a* is, for example, an upper half of a portion of the elastic sheet 55 that faces the vertical surface 62*b*, and is bonded to the upper portion of the vertical surface 62*b* by means of, for example, an adhesive.

The lower end 55*b* of the elastic sheet 55, which is a free end, projects downward from the lower end of the inclined surface 52, which is the first inclined surface 62*e*, and is shaped to extend substantially straight and parallel to the rotating shaft 64*a* of the transport member 64 in the vicinity of the transporting projection 64*b* of the transport member 64.

Figure 12:
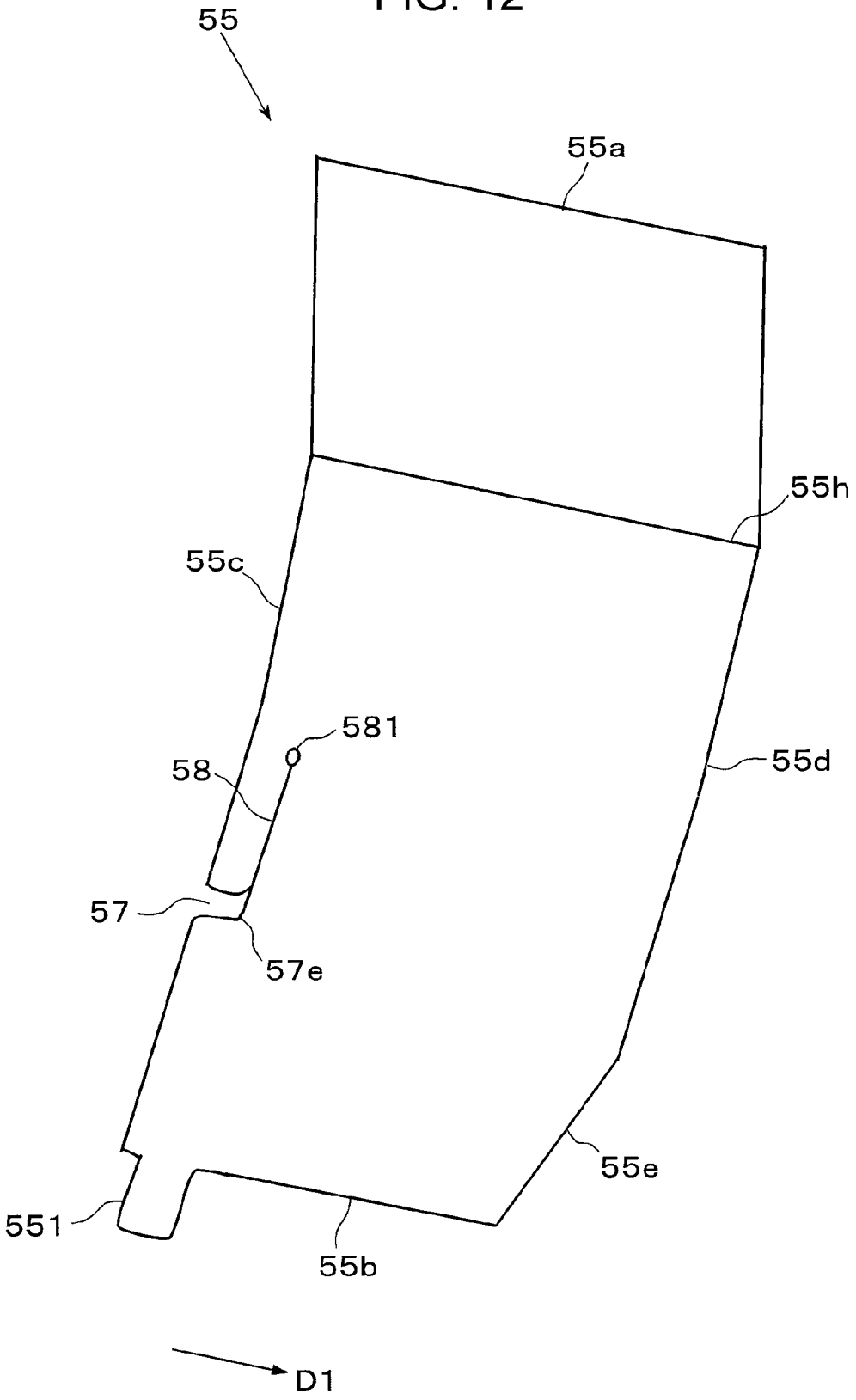
FIG. 12 is a perspective view of an elastic sheet disposed in the developer container illustrated in FIG. 7.

As illustrated in, for example, FIGS. 7 and 12, the elastic sheet 55 is bent at a portion 55*h* corresponding to a boundary (line) between the vertical surface 62*b* and the first inclined surface 62*e* of the storage space unit 62 so that the elastic sheet 55 may be easily brought into contact with and extend along the vertical surface 62*b* and the first inclined surface 62*e*.

As illustrated in FIG. 8, the elastic sheet 55 has a cut portion 55*e* formed at the bottom of a side thereof adjacent to the vertical surface 62*d* of the storage space unit 62. The cut portion 55*e* is cut along an oblique line extending from the vertical surface 62*d* toward the inner region of the interior space S1. The cut portion 55*e* is formed to avoid interference with a drive transmission storage 625 of the container body 60. The drive transmission storage 625 is a structural part provided to protrude into the storage space unit 62 in a region extending downward from a location below the first inclined surface 62*e* to end portions of the transport unit 63 and the delivery unit 66 in the container body 60.

In the developer transport device 5A, as illustrated in FIGS. 7 to 9, the elastic sheet 55 has a projection 551 at the lower end 55*b* thereof, and a contact body 59 is provided in the passage space S2 of the transport unit 63. The contact body 59 repeats a sequential movement of coming into contact with the projection 551 to raise a portion of the elastic sheet 55 and then moving away from the projection 551.

In addition, in the developer transport device 5A, as illustrated in FIGS. 7 to 10, a protrusion 56 protrudes from a portion of the inclined surface 52 such that an upstream edge 55*c* (portion thereof) of the elastic sheet 55 in the transporting direction D1 is maintained separated from the inclined surface 52.

In addition, in the developer transport device 5A, as illustrated in, for example, FIGS. 7 and 8, the elastic sheet 55 has a first cut 57 that extends inward from the upstream edge 55*c* in the transporting direction D1 and a second cut 58 that extends from an end 57*e* of the first cut 57 toward the upper end 55*a* of the elastic sheet 55.

The projection 551 is provided on the lower end 55*b* of the elastic sheet 55 at a position near the upstream end in the transporting direction D1 in which the transport member 54 transports the toner 18At, and is shaped to project continuously from the lower end 55*b*.

The projection 551 is positioned near the upstream end of the elastic sheet 55 in the transporting direction D1. More specifically, as illustrated in, for example, FIG. 13, the projection 551 may be disposed within a range of ¼ of an overall width W2 of the lower end 55*b* of the elastic sheet 55 in the transporting direction D1.

When the projection 551 is not in this range, there is a risk that, for example, a portion of the elastic sheet 55 cannot be easily elastically deformed to be warped and bent toward a downstream side in the transporting direction D1 as described below. The portion of the elastic sheet 55 is a portion including at least the upstream edge 55*c* in the transporting direction D1 and the lower end 55*b*.

Although the projection 551 has a rectangular shape in plan view, the shape thereof in plan view is not limited to this. The dimension by which the projection 551 projects may be any dimension as long as the projection 551 is capable of coming into contact with the contact body 59 so that a portion of the elastic sheet 55 is raised and elastically deformed to be warped and bent toward the downstream side in the transporting direction D1. The projection 551 is not provided in a downstream region (half) of the lower end 55*b* of the elastic sheet 55 in the transporting direction D1.

As illustrated in, for example, FIGS. 7 to 9 and 11, the contact body 59 is provided at an upstream end of the transport member 54 in the transporting direction D1.

More specifically, as illustrated in, for example, FIG. 11, the contact body 59 is a plate-shaped structural part that projects from the outer peripheral surface of the rotating shaft 64*a* of the transport member 54 at an upstream end portion of the rotating shaft 64*a* in the transporting direction D1 and that extends substantially parallel to the axial direction of the rotating shaft 64*a*.

As illustrated in FIG. 11, the contact body 59 according to the first exemplary embodiment is disposed between the support portion 64*c* and the transporting projection 64*b* of the transport member 54, and has the same height as those of the top portions (outer peripheral portions) of the support portion 64*c* and the transporting projection 64*b*.

The contact body 59 rotates around the rotating shaft 64*a* as the transport member 54 rotates, and moves so as to temporarily contact and then move past the projection 551 of the elastic sheet 55 during the movement thereof.

Figure 10:
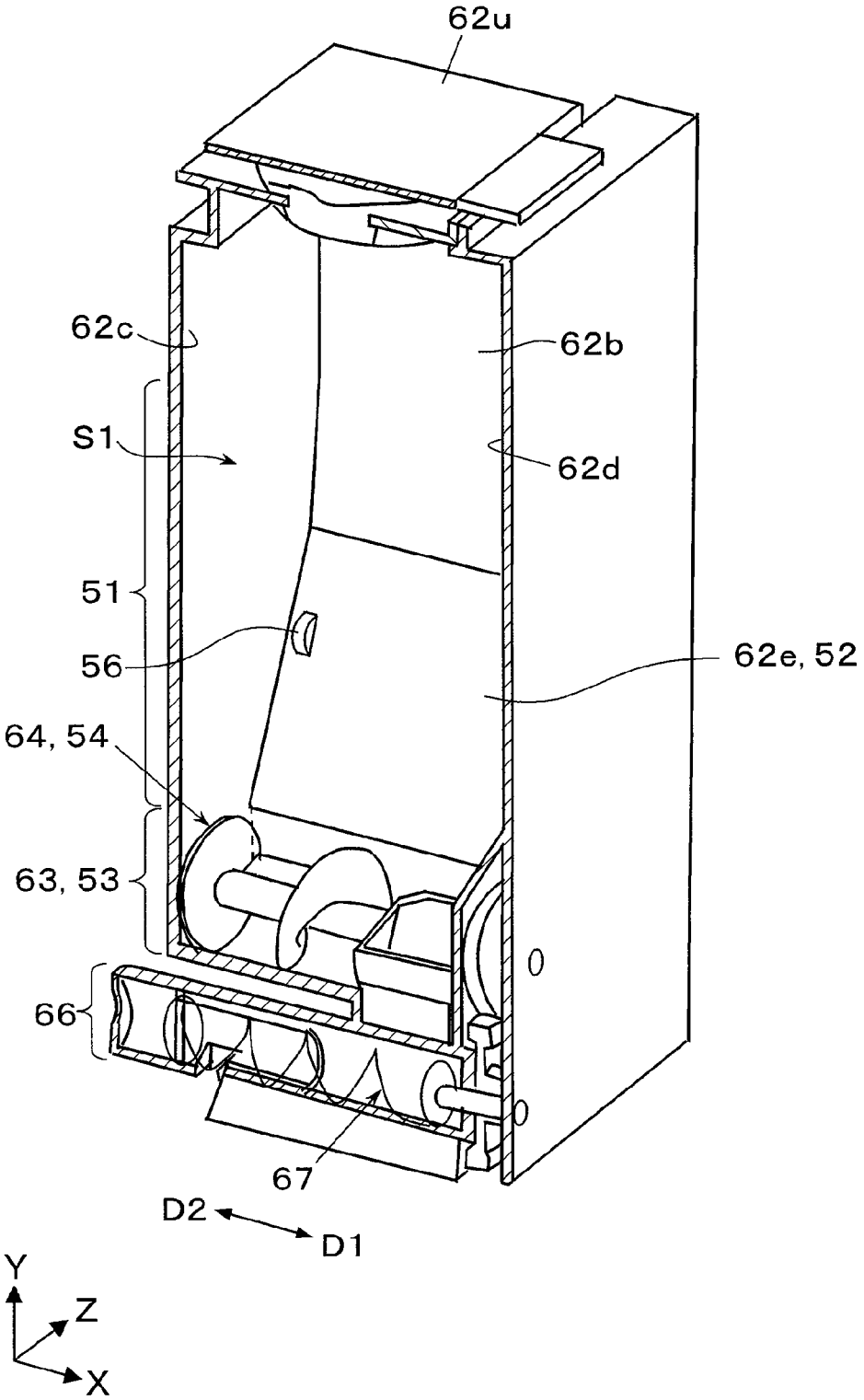
FIG. 10 is a schematic perspective view of the developer container illustrated in FIG. 7 to which no elastic sheet is attached.

As illustrated in, for example, FIGS. 9 and 10, the protrusion 56 is an arc-shaped structural part that protrudes from the inclined surface 52 at a location near the upstream end of the inclined surface 52 in the transporting direction D1.

The protrusion 56 is disposed in an upper half of the entire area of the inclined surface 52 in the vertical direction.

Figure 13:
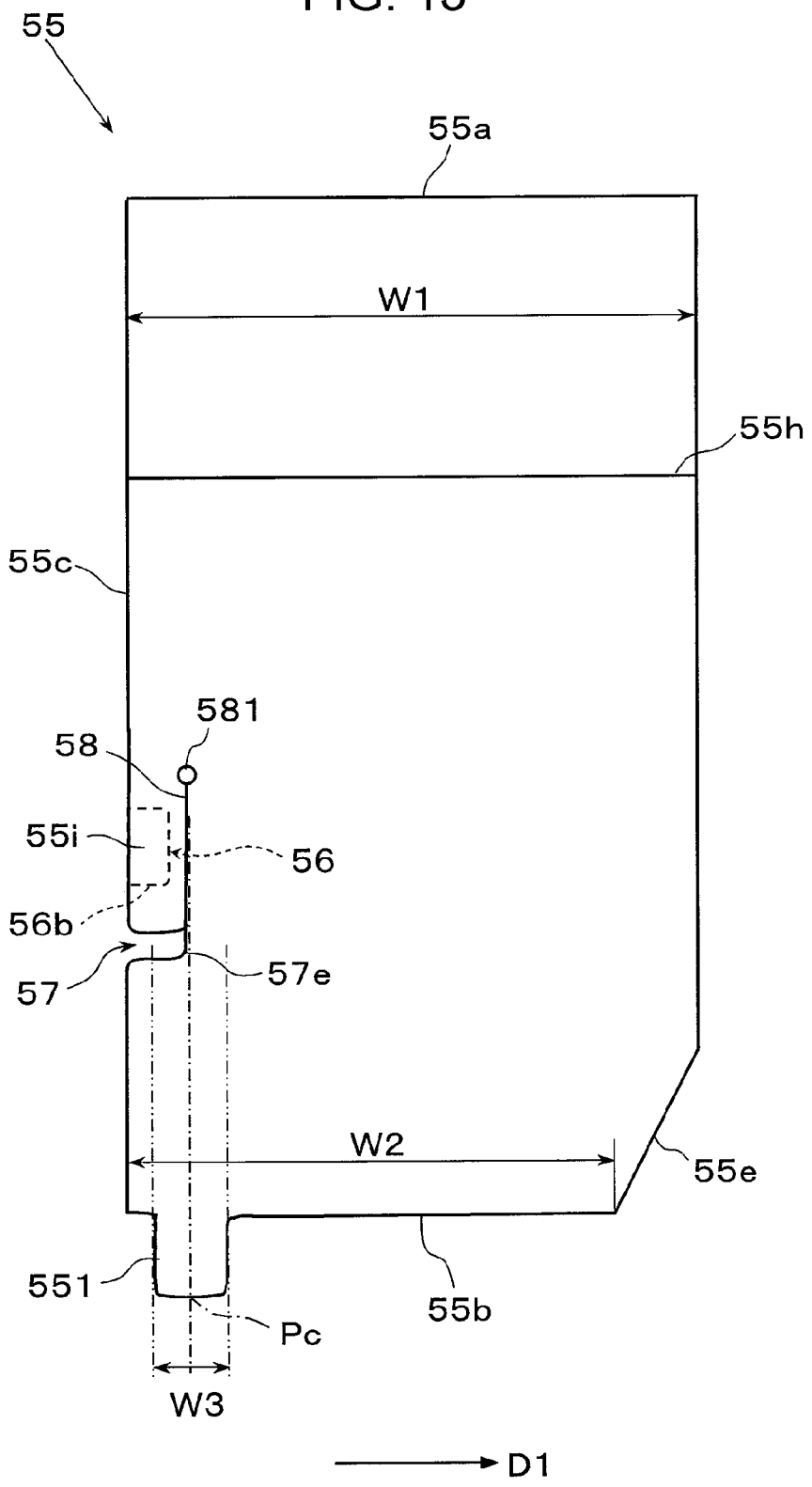
FIG. 13 is a schematic diagram illustrating the structure of the elastic sheet illustrated in FIG. 12.

In addition, as illustrated in FIGS. 8 and 13, the protrusion 56 is disposed upstream in the transporting direction D1 relative to a center position Pc of the projection 551 in the transporting direction D1. When the protrusion 56 is disposed downstream in the transporting direction D1 relative to the center position Pc of the projection 551, the developer cannot be appropriately transported by the elastic sheet 55 that is bent, and defects such as variations in the density of a developed image may occur as a result.

The first cut 57 extends straight and substantially parallel to the transporting direction D1 from the upstream edge 55*c* of the elastic sheet 55 in the transporting direction D1.

In the first exemplary embodiment, the first cut 57 is not a simple linear cut, but is formed by cutting out a portion of the elastic sheet 55 having a predetermined width. When the first cut 57 is formed to have a predetermined width, the amount by which the elastic sheet 55 is bent may be increased so that transporting force applied to the developer is increased.

In addition, the first cut 57 is provided at substantially the center of the entire area of a portion that covers the inclined surface 52 in the vertical direction.

Furthermore, as illustrated in FIGS. 8 and 13, an end 57*e* of the first cut 57 is positioned within a range corresponding to a width W3 of the projection 551 of the elastic sheet 55 in the transporting direction D1.

When the first cut 57 has a short length such that the end 57*e* does not reach the range corresponding to the width W3 of the projection 551 of the elastic sheet 55, transporting force applied to the developer by the elastic sheet 55 that is bent is reduced, and defects such as variations in the density of a developed image may occur. When the first cut 57 has a long length such that the end 57*e* is positioned beyond the range corresponding to the width W3 of the projection 551 of the elastic sheet 55, the developer cannot be easily moved and tends to remain in the container. Accordingly, there is a risk that, for example, loss due to the developer that remains unused in the container will be increased.

As illustrated in FIGS. 8 and 13, the first cut 57 is positioned below a lower end 56*b* of the protrusion 56. The position below the lower end 56*b* of the protrusion 56 is, for example, a position separated from the lower end 56*b* by about 5 mm to about 10 mm. When the first cut 57 is not positioned below the lower end 56*b* of the protrusion 56, transporting force applied to the developer by the elastic sheet 55 that is bent is reduced, and defects such as variations in the density of a developed image may occur.

The second cut 58 is formed in the elastic sheet 55 so as to extend toward the upper end 55*a* of the elastic sheet 55 in a direction that crosses the transporting direction D1. The direction that crosses the transporting direction D1 may be a direction at an angle in the range of, for example, ±5° relative to a direction orthogonal to the transporting direction D1. Referring to, for example, FIG. 12, a through hole 581 is provided at the upper end of the second cut 58 to prevent unnecessary elongation of the second cut 58.

The second cut 58 may be formed such that an end (upper end) thereof is positioned above an upper end 56*a* of the protrusion 56.

As illustrated in FIGS. 8 and 13, the second cut 58 is positioned downstream of the protrusion 56 in the transporting direction D1. The position downstream of the protrusion 56 in the transporting direction D1 is, for example, a position separated from the protrusion 56 by about 2 mm to about 5 mm. When the second cut 58 is not positioned downstream of the protrusion 56 in the transporting direction D1, transporting force applied to the developer by the elastic sheet 55 that is bent is reduced, and defects such as variations in the density of a developed image may occur.

In this developer transport device 5A, the protrusion 56 is provided on the inclined surface 52, and the elastic sheet 55 has the first cut 57 and the second cut 58. Therefore, the elastic sheet 55 has a portion that is in a different state.

More specifically, as illustrated in FIG. 9, a part of the elastic sheet 55 that covers the inclined surface 52 includes a portion 55*i* surrounded by the first cut 57 and the second cut 58 and provided on the protrusion 56 at an upstream end in the transporting direction D1, the portion 55*i* being placed on the protrusion 56 and raised from the inclined surface 52. The part of the elastic sheet 55 that covers the inclined surface 52 is substantially in contact with the inclined surface 52 in a region excluding the portion 55*i*.

Structure for Collecting Developer

As conceptually illustrated in FIG. 5, the image forming apparatus 1A is configured such that unnecessary substances including toner removed by the first cleaning devices 26 of the image forming devices 20Y, 20M, 20C, and 20K are collected by first collection containers 65Y, 65M, 65C, and 65K through first collecting paths 29Y, 29M, 29C, and 29K, respectively, and such that unnecessary substances including toner removed by the second cleaning device 36 of the intermediate transfer device 30 is collected by a second collection container 68 through a second collecting path 37.

Each of the first collecting paths 29Y, 29M, 29C, and 29K is, for example, a cylindrical structure formed on one side of a housing 26*a* of a corresponding one of the first cleaning devices 26Y, 26M, 26C, and 26K by extending a transport member 26*c* toward the container attachment unit 14. The second collecting path 37 is, for example, a cylindrical structure formed on one side of a housing 36*a* of the second cleaning device 36 by extending a transport member 36*c* toward the container attachment unit 14.

When the first cleaning devices 26Y, 26M, 26C, and 26K and the second cleaning device 36 are installed in the housing 10, the first collecting paths 29Y, 29M, 29C, and 29K and the second collecting path 37 project outward, as illustrated in FIG. 4, through communicating portions (not illustrated) provided in the container attachment unit 14, and projecting end portions thereof each have a discharge hole and an openable lid (not illustrated) on a lower surface thereof. The first collecting paths 29Y, 29M, 29C, and 29K and the second collecting path 37 are connected to collecting receivers (not illustrated) of the first collection containers 65Y, 65M, 65C, and 65K and the second collection container 68, respectively, in the container attachment unit 14.

In the first exemplary embodiment, the first collection containers 65Y, 65M, 65C, and 65K are respectively integrated with the developer containers 61Y, 61M, 61C, and 61K.

The first collection containers 65Y, 65M, 65C, and 65K may instead be independent of and separated from the developer containers 61Y, 61M, 61C, and 61K. In such a case, the first collection containers 65Y, 65M, 65C, and 65K may be formed as a single first collection container 65. When a single first collection container 65 is provided, the unnecessary substances including toner collected by the first cleaning devices 26 are collected together in the single first collection container 65.

Operation of Developer Transport Device in Each Developer Container

The operation of the developer transport device 5A included in each of the developer containers 61Y, 61M, 61C, and 61K of the developer supply device 7A will now be described.

When the developer supply device 7A is required to supply the toner 18At from one of the developer containers 61Y, 61M, 61C, and 61K, the transport member 64 and the transport member 67 of the developer container 61 from which the toner 18At is to be supplied are rotated in a predetermined direction for a predetermined time by receiving rotating power transmitted from the corresponding one of the driving-force-transmitting units 28 disposed in the container attachment unit 14 through the transmission gears 68A and 68B.

Figure 14:
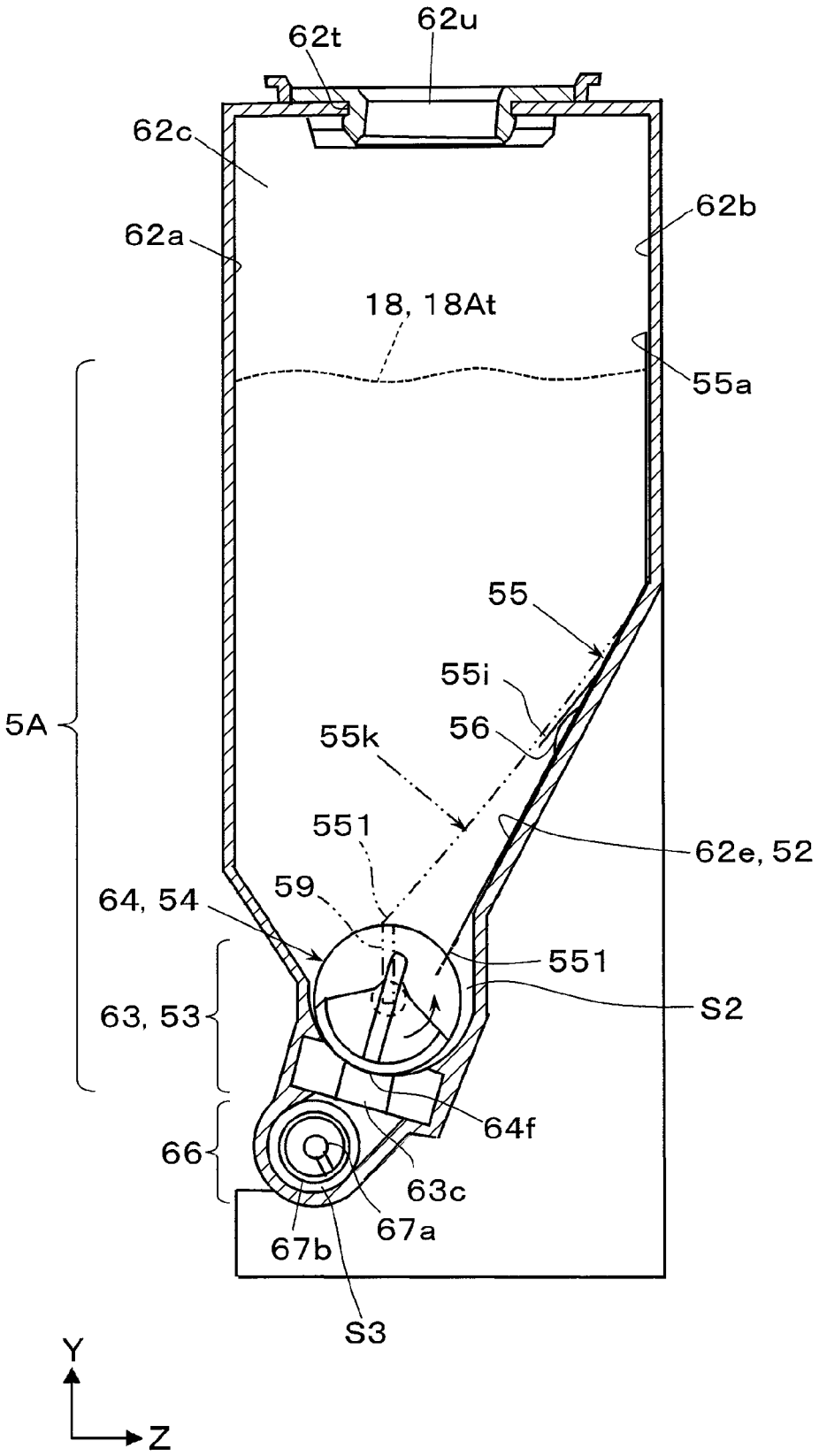
FIG. 14 is a schematic diagram illustrating the elastic sheet disposed in the developer container illustrated in FIG. 7 and an example of the manner in which the elastic sheet is elastically deformed.

Accordingly, in the developer container 61 from which the toner 18At is to be supplied, as illustrated in FIG. 14, the transport member 54, which is also the transport member 64, rotates in the direction shown by the arrow in the passage space S2 of the transport passage unit 53, which is also the transport unit 63, to generate transporting force by which the toner 18At is moved and transported in the transporting direction D1.

The toner 18At that has been transported to the downstream end of the transport passage unit 53 in the transporting direction D1 is scooped by the recess 64*d* in the feeding portion 64*e* of the transport member 54, and then falls into the delivery unit 66 through the feed port 63*c* in the transport passage unit 53 when the recess 64*d* faces the feed port 63*c*.

Subsequently, in the above-described developer container 61, the transport member 67 rotates in a predetermined direction in the passage space S3 of the delivery unit 66 to generate transporting force by which the toner 18At fed from the transport unit 63 is moved and transported in the delivery direction D2.

The toner 18At that has been transported to the downstream end of the delivery unit 66 in the delivery direction D2 falls into the supply path 27 connected to the developer container 61 through the opening 69*c* in the movable shutter 69 and the discharge hole 66*c* in the delivery unit 66.

Finally, the toner 18At discharged to the supply path 27 of the developer supply device 7A is transported and supplied to the housing 24*a* of the developing device 24 corresponding to the supply path 27 because the portion extended from the stirring-and-transporting member 24*c* of the developing device 24 is rotated in the same direction as the rotating direction of the stirring-and-transporting member 24*c*.

In the above-described developer container 61 from which the toner 18At is to be supplied, when the transport member 54 rotates in the passage space S2 of the transport passage unit 53 to supply the toner 18At, the contact body 59 provided on the transport member 54 repeats a sequential movement of temporarily or periodically contacting the projection 551 of the elastic sheet 55 and then moving past the projection 551 of the elastic sheet 55.

When the contact body 59 comes into contact with the projection 551 of the elastic sheet 55 included in the developer transport device 5A of the developer container 61, the projection 551 is raised from below by the contact body 59 that moves together with the transport member 54 that rotates in the direction shown by the arrow. Therefore, as shown by the two-dot chain lines in FIGS. 14 and 15, the upstream edge 55*c* of the elastic sheet 55 in the transporting direction D1 is gradually raised from the lower end 55*b*.

Figure 15:
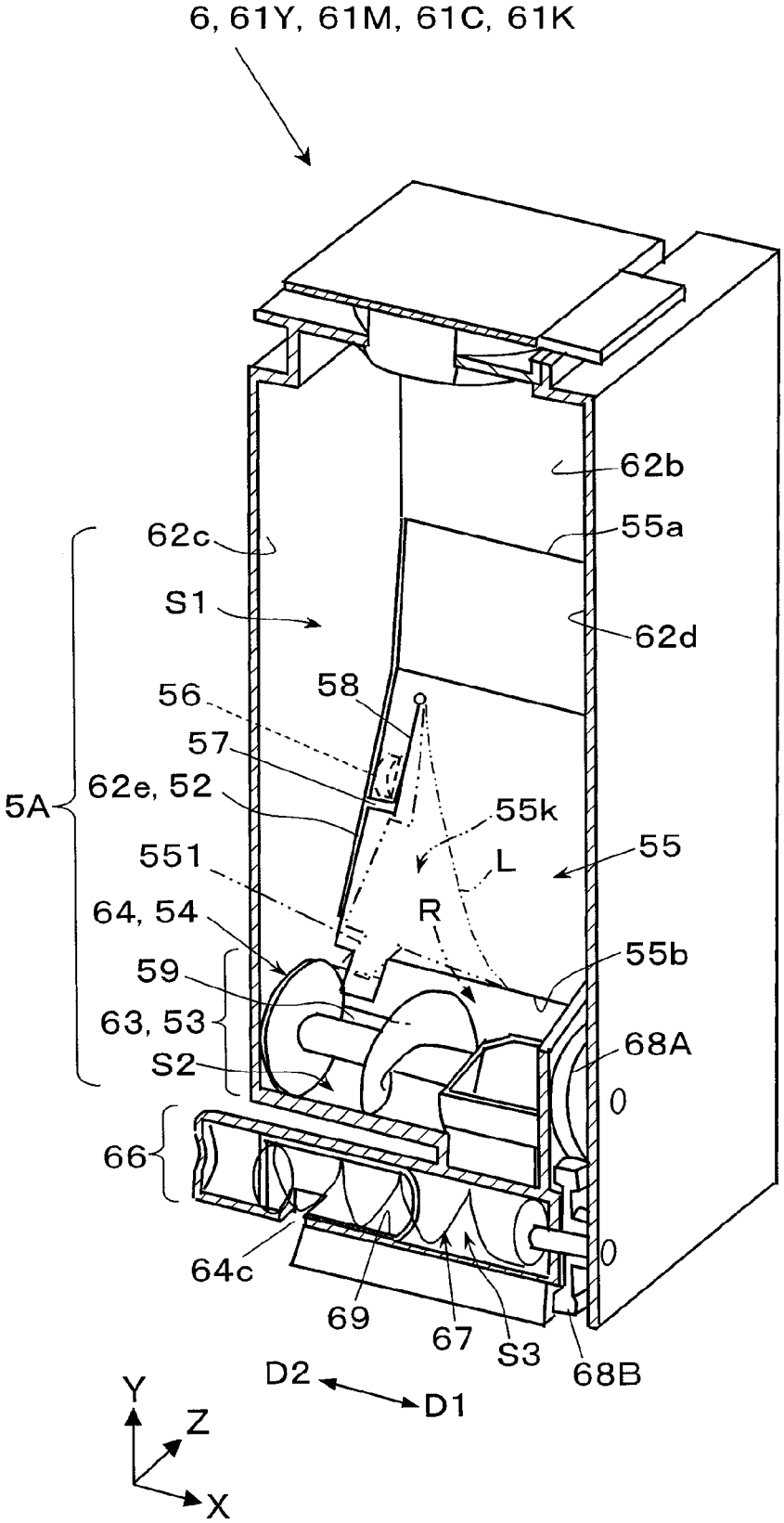
FIG. 15 is a schematic perspective view illustrating the elastic sheet disposed in the developer container illustrated in FIG. 7 and an example of the manner in which the elastic sheet is elastically deformed.
Figure 16:
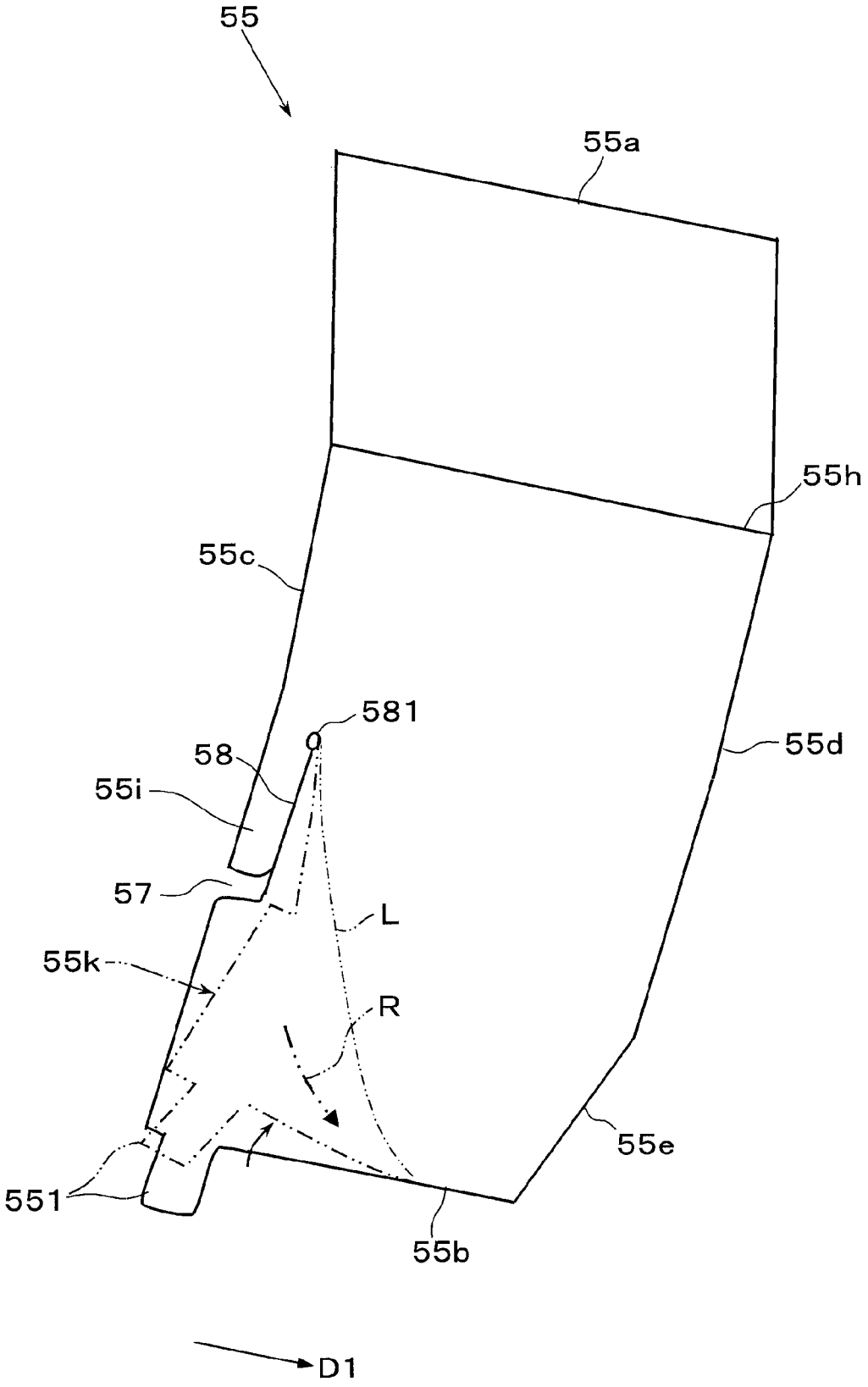
FIG. 16 is a perspective view illustrating an example of the manner in which the elastic sheet illustrated in FIG. 12 is elastically deformed.

Accordingly, as shown by the two-dot chain lines in FIGS. 15 and 16, an upstream portion 55*k* of the elastic sheet 55 in the transporting direction D1 is elastically deformed to be warped and bent obliquely upward and toward the downstream side in the transporting direction D1. The portion 55*k* of the elastic sheet 55 is elastically deformed in a region having the first cut 57 and the second cut 58 at a boundary thereof and excluding the portion 55*i* placed on the protrusion 56. The portion 55*k* of the elastic sheet that is elastically deformed is raised upward away from the inclined surface 52.

FIGS. 15 and 16 show a two-dot chain line L representing an example of a boundary between the portion 55*k* of the elastic sheet that is elastically deformed and other portions, that is, portions that are not elastically deformed.

When the contact body 59 moves past the projection 551 after coming into contact therewith, the portion 55*k* of the elastic sheet 55 that has been elastically deformed as described above is no longer raised by the contact body 59, and therefore returns to its original state. More specifically, the portion 55*k* of the elastic sheet 55 returns to a state in which the portion 55*k* is in contact with the inclined surface 52.

Thus, when the contact body 59 repeatedly comes into contact with and moves past the projection 551, the portion 55*k* of the elastic sheet 55 is repeatedly elastically deformed and restored from the elastically deformed state.

As a result, the toner 18At stored in the storage space unit 62 of the developer container 61 is moved when the portion 55*k* of the elastic sheet 55 of the developer transport device 5A is elastically deformed as described above.

In particular, if the toner 18At may aggregate or has aggregated before falling into the transport passage unit 53 connected to the bottom of the falling passage unit 51 having the inclined surface 52, which is inclined so as to narrow the interior space S1 of the storage space unit 62, the toner 18At in such a state may be loosened by the movement of the portion 55*k* of the elastic sheet 55 that is elastically deformed as described above.

In this case, since the portion 55*k* of the elastic sheet 55 is elastically deformed to be warped and bent obliquely upward and toward the downstream side in the transporting direction D1 as described above, the loosened toner 18At may be moved downstream in the transporting direction D1, as shown by a two-dot-chain-line arrow R in FIGS. 15 and 16.

Thus, according to the elastic sheet 55 of the developer transport device 5A, the portion 55*k* thereof is elastically deformed in the above-described manner so that the toner 18At in the falling passage unit 51 is not simply loosened before the toner 18At falls into the transport passage unit 53, but may also be moved downstream in the transporting direction D1 of the transport passage unit 53. Thus, the elastic sheet 55 serves to assist the transportation of the toner 18At in the transporting direction D1 by the transport member 54 in the transport passage unit 53.

Thus, in the developer container 61 from which the toner 18At is to be supplied, the elastic sheet 55 of the developer transport device 5A moves such that the toner 18At in the falling passage unit 51 falls into the transport passage unit 53 at least without stopping due to aggregation and is reliably transported in the transporting direction D1. Then, the toner 18At is fed from the transport passage unit 53 to the delivery unit 66 and discharged from the container body 60.

Accordingly, in the developer container 61, even when the toner 18At may aggregate or has aggregated before falling into the transport passage unit 53, the toner 18At in such a state may be loosened by the movement of the portion 55*k* of the elastic sheet 55. In addition, the loosened toner 18At may be moved downstream in the transporting direction D1.

Accordingly, in the developer containers 61Y, 61M, 61C, and 61K which each include the developer transport device 5A and in the developer supply device 7A including the developer containers 61Y, 61M, 61C, and 61K, the toner 18At stored in the container body 60 may be smoothly fed from the container body 60 with small variations due to aggregation, and the amount of the toner 18At that remains in the container body 60 due to aggregation may be reduced.

In the developer containers 61Y, 61M, 61C, and 61K, the elastic sheet 55 has the first cut 57 and the second cut 58. Therefore, when the contact body 59 comes into contact with the projection 551, the portion 55*k* of the elastic sheet 55 is elastically deformed in a region having the first cut 57 and the second cut 58 at a boundary thereof and excluding the portion 55*i* placed on the protrusion 56, as described above. Accordingly, for example, the developer-transporting performance of the elastic sheet 55 that is bent may be improved.

In addition, in the developer containers 61Y, 61M, 61C, and 61K, the protrusion 56 is positioned upstream in the transporting direction D1 relative to the center position Pc (see FIG. 13) of the projection 551 of the elastic sheet 55 in the transporting direction D1. Therefore, compared to the case where the protrusion 56 is not positioned in this manner, the portion 55*k* of the elastic sheet 55 may be more easily elastically deformed to be warped and bent obliquely upward and toward the downstream side in the transporting direction D1 of the toner 18At as described above. Accordingly, the loosened toner 18At may be more easily moved in the transporting direction D1 by the portion 55*k* of the elastic sheet 55 that is elastically deformed.

In addition, in the developer containers 61Y, 61M, 61C, and 61K, the end 57*e* of the first cut in the elastic sheet 55 is positioned within a range corresponding to the width W3 of the projection 551 in the transporting direction D1. Therefore, compared to the case where the end 57*e* of the first cut is not positioned in this manner, the portion 55*k* of the elastic sheet 55 raised when the contact body 59 comes into contact with the projection 551 may be more easily elastically deformed to be bent from the upstream side toward the downstream side in the transporting direction D1 of the toner 18At. Also in this case, the loosened toner 18At may be more easily moved in the transporting direction D1 by the portion 55*k* of the elastic sheet 55 that is elastically deformed.

In addition, in the developer containers 61Y, 61M, 61C, and 61K, the elastic sheet 55 has the second cut 58 that extends from the end 57*e* of the first cut toward the upper end 55*a*. Therefore, compared to the case where the second cut 58 is not formed, the portion 55*k* of the elastic sheet 55 raised when the contact body 59 comes into contact with the projection 551 may be more easily elastically deformed to be bent from the upstream side toward the downstream side in the transporting direction D1 of the toner 18At over a region including a region above the first cut 57. Also in this case, the loosened toner 18At may be more easily moved in the transporting direction D1 by the portion 55*k* of the elastic sheet 55 that is elastically deformed.

In addition, in the developer containers 61Y, 61M, 61C, and 61K, the second cut 58 is formed in the elastic sheet 55 so as to extend in a direction that crosses the transporting direction D1 of the toner 18At. Therefore, compared to the case where the second cut 58 is not formed to extend in the direction that crosses the transporting direction D1, the portion 55*k* of the elastic sheet 55 raised when the contact body 59 comes into contact with the projection 551 may be more easily and reliably elastically deformed to be bent from the upstream side toward the downstream side in the transporting direction D1 of the toner 18At over a region including a region above the first cut 57.

In addition, in the developer containers 61Y, 61M, 61C, and 61K, the first cut 57 is positioned below the lower end 56*b* of the protrusion 56. Therefore, compared to the case where the first cut 57 is not positioned below the lower end 56*b* of the protrusion 56, the portion 55*k* of the elastic sheet 55 (more specifically, a portion below the lower end 56*b* of the protrusion 56) that is raised when the contact body 59 comes into contact with the projection 551 moves relative to the inclined surface 52 by a greater distance (further away from the inclined surface 52). Accordingly, in the developer container 61Y and other developer containers, the toner 18At may be more easily loosened by the portion 55*k* of the elastic sheet 55 that is elastically deformed, and the loosened toner 18At may be more easily moved in the transporting direction D1. Also, the toner 8At is prevented from entering and being stuck in a space between part of the portion 55*k* of the elastic sheet 55 that is below the lower end 56*b* of the protrusion 56 and the inclined surface 52.

In addition, in the developer containers 61Y, 61M, 61C, and 61K, the second cut 58 is positioned downstream of the protrusion 56 in the transporting direction D1 of the toner 18At. Therefore, compared to the case where the second cut 58 is not positioned downstream of the protrusion 56, the portion 55*k* of the elastic sheet 55 raised when the contact body 59 comes into contact with the projection 551 moves relative to the inclined surface 52 by a greater distance.

The developer containers 61Y, 61M, 61C, and 61K each include the developer transport device 5A, and the image forming apparatus 1A includes the developer supply device 7A including the developer containers 61Y, 61M, 61C, and 61K. According to the developer containers 61Y, 61M, 61C, and 61K and the image forming apparatus 1A, in contrast to the case where each developer container 61 does not include the developer transport device 5A, the toner 18At may be moved and loosened in the developer container 61 before falling into the transport passage unit 53, which is connected to the bottom of the falling passage unit 51 having the inclined surface 52, and the loosened toner 18At may be moved in the transporting direction D1 in which the toner 18At is transported in the transport passage unit 53.

As a result, the toner 18At may be fed from each developer container 61 with small variations due to aggregation, and the amount of the toner 18At that remains in each developer container 61 may be reduced. Thus, the toner 18At in each developer container 61 may be smoothly transported to the image forming unit 2A, more specifically, to the corresponding one of the developing devices 24 of the image forming unit 2A.

Modifications of First Exemplary Embodiment

Figure 17:
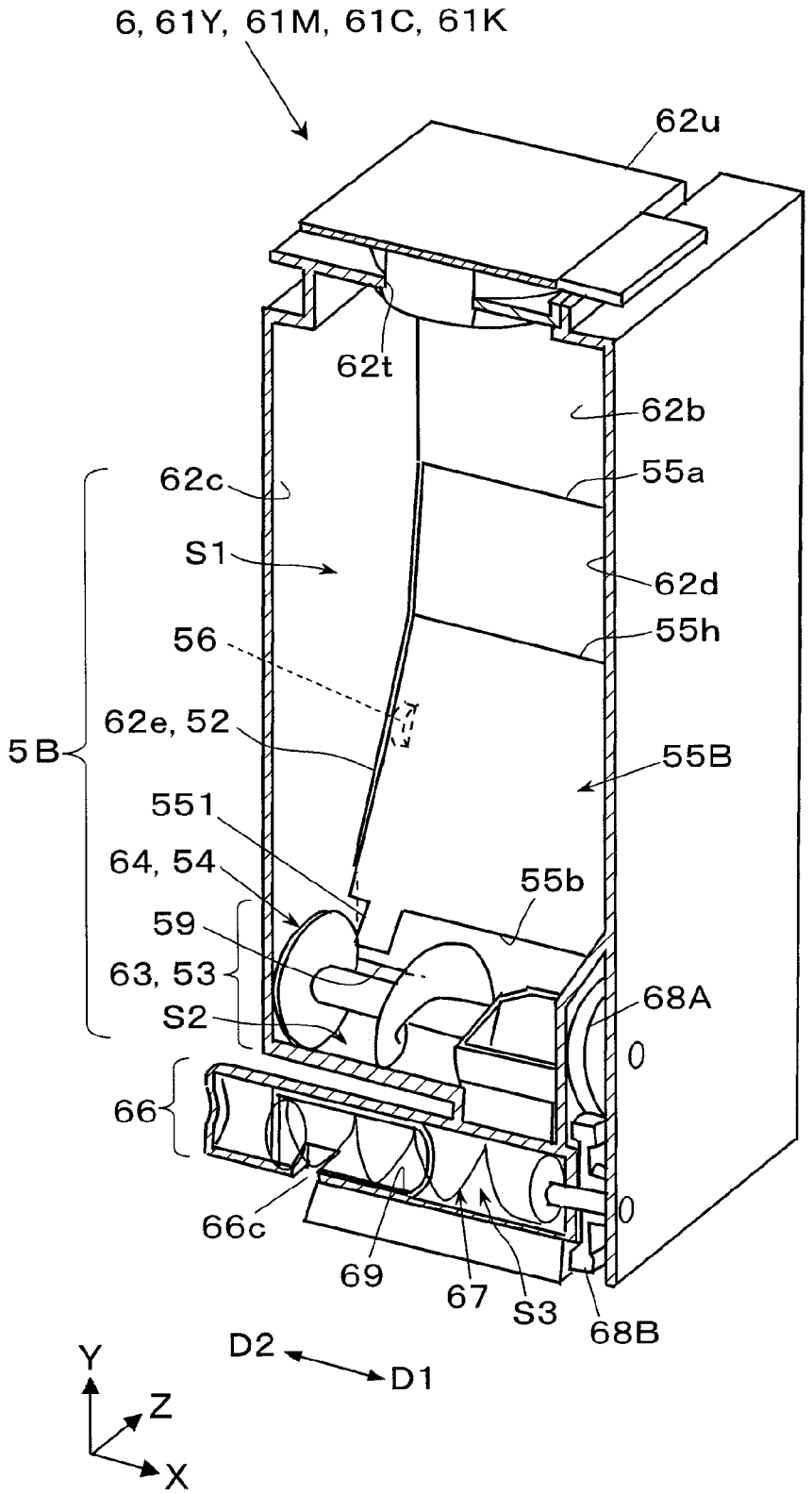
FIG. 17 is a schematic sectional perspective view of a developer container according to a first modification of the first exemplary embodiment.

FIG. 17 illustrates the structure of developer containers 61Y, 61M, 61C, and 61K according to a first modification of the first exemplary embodiment.

The developer containers 61Y, 61M, 61C, and 61K according to the first modification differ from the developer containers 61Y, 61M, 61C, and 61K according to the first exemplary embodiment (see, for example, FIG. 7) in that the developer transport device 5A according to the first exemplary embodiment is replaced by a developer transport device 5B including an elastic sheet 55B that does not have the first cut 57 or the second cut 58.

The developer transport device 5B has the same structure as that of the developer transport device 5A according to the first exemplary embodiment except that the elastic sheet 55B does not have the first cut 57 or the second cut 58 according to the first exemplary embodiment (see, for example, FIG. 8). In the developer transport device 5B, since the elastic sheet 55B does not have the first cut 57 or the second cut 58, a side portion of a part of the elastic sheet 55B that covers the inclined surface 52, the side portion including the upstream edge 55*c* in the transporting direction D1 of the toner 18At, is partially placed on the protrusion 56 and raised from the inclined surface 52.

Also in the developer containers 61Y, 61M, 61C, and 61K according to the first modification, when it is required to supply the toner 18At, the transport member 54 rotates in the passage space S2 of the transport passage unit 53 of the developer transport device 5B included in the developer container 61 from which the toner 18At is to be supplied. Accordingly, the contact body 59 repeats a sequential movement of contacting and then moving past the projection 551 of the elastic sheet 55B.

The projection 551 of the elastic sheet 55B of the developer transport device 5B is raised from below when the contact body 59 comes into contact therewith. Accordingly, as shown by the two-dot chain lines in FIG. 18, an upstream portion 55*kb* of the elastic sheet 55B in the transporting direction D1 is elastically deformed to be warped and bent obliquely upward and toward the downstream side in the transporting direction D1.

The portion 55*kb* of the elastic sheet 55B that is elastically deformed is a side portion including the upstream edge 55*c*. Since the side portion including the upstream edge 55*c* in the transporting direction D1 is constantly raised from the inclined surface 52 by the protrusion 56, compared to the case where the protrusion 56 is not provided, the portion 55*kb* of the elastic sheet 55B may be more easily elastically deformed to be warped and bent toward the downstream side in the transporting direction D1.

Figure 18:
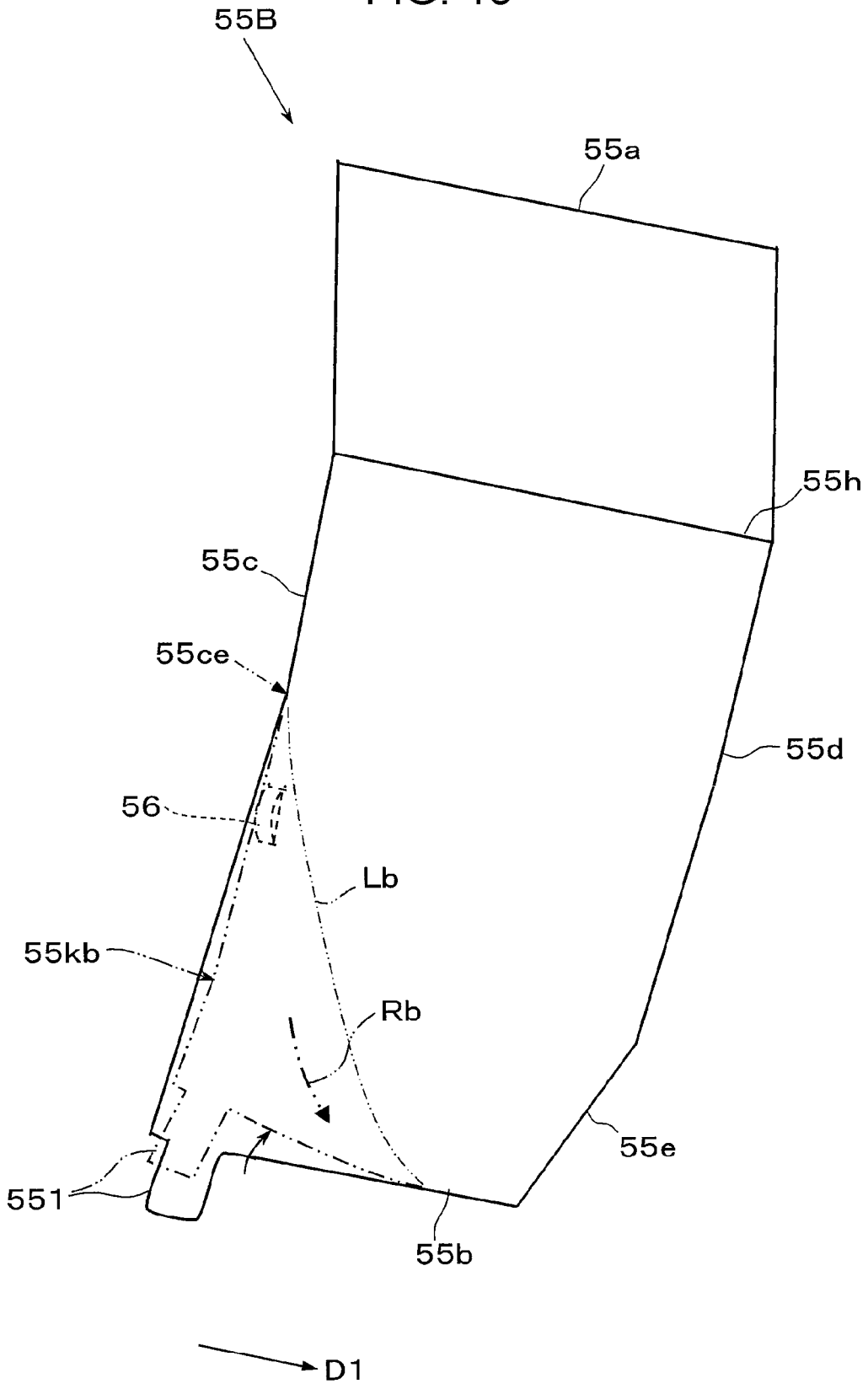
FIG. 18 is a schematic perspective view illustrating an elastic sheet disposed in the developer container illustrated in FIG. 17 and an example of the manner in which the elastic sheet is elastically deformed.

FIG. 18 shows a two-dot chain curve Lb representing an example of a boundary between the portion 55*kb* of the elastic sheet 55B that is elastically deformed and other portions that are not elastically deformed. One end of the boundary represented by the curve Lb reaches, for example, a portion 55*ce* that is on the upstream edge 55*c* of the elastic sheet 55B and above the protrusion 56. Thus, the portion 55*kb* of the elastic sheet 55B that is elastically deformed is broader than the portion 55*k* of the elastic sheet 55 according to the first exemplary embodiment.

As a result, in the above-described developer container 61, before the toner 18At stored in the storage space unit 62 falls into the transport passage unit 53 connected to the bottom of the falling passage unit 51, the toner 18At is loosened by the movement of the portion 55*kb* of the elastic sheet 55B that is elastically deformed. In addition, the loosened toner 18At is moved downstream in the transporting direction D1, as shown by a two-dot-chain-line arrow Rb in FIG. 18, by the portion 55*kb* of the elastic sheet 55B that is elastically deformed.

Accordingly, even when the toner 18At may aggregate or has aggregated before falling into the transport passage unit 53, the toner 18At in such a state may be loosened by the movement of the portion 55*kb* of the elastic sheet 55B. In addition, the loosened toner 18At may be moved downstream in the transporting direction D1.

Figure 19:
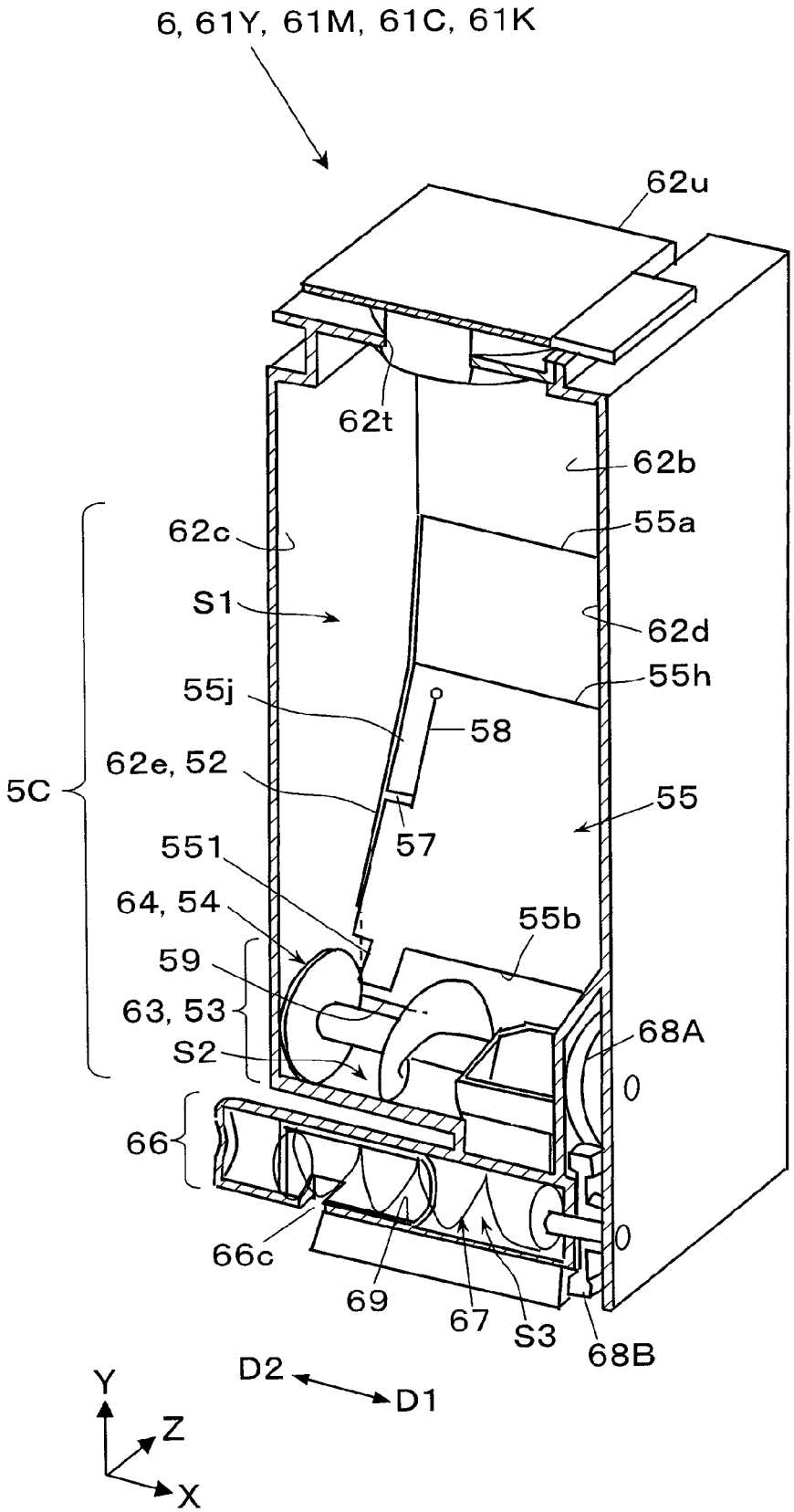
FIG. 19 is a schematic sectional perspective view of a developer container according to a second modification of the first exemplary embodiment.

FIG. 19 illustrates the structure of developer containers 61Y, 61M, 61C, and 61K according to a second modification of the first exemplary embodiment.

The developer containers 61Y, 61M, 61C, and 61K according to the second modification differ from the developer containers 61Y, 61M, 61C, and 61K according to the first exemplary embodiment (see, for example, FIG. 7) in that the developer transport device 5A according to the first exemplary embodiment is replaced by a developer transport device 5C that does not have the protrusion 56.

The developer transport device 5C has the same structure as that of the developer transport device 5A according to the first exemplary embodiment except that the inclined surface 52 of the container body 60 does not have the protrusion 56 according to the first exemplary embodiment (see, for example, FIG. 10). In the developer transport device 5C, since the inclined surface 52 does not have the protrusion 56, a part of the elastic sheet 55 that covers the inclined surface 52 is substantially in contact with the inclined surface 62.

Also in the developer containers 61Y, 61M, 61C, and 61K according to the second modification, when it is required to supply the toner 18At, the transport member 54 rotates in the passage space S2 of the transport passage unit 53 of the developer transport device 5C included in the developer container 61 from which the toner 18At is to be supplied. Accordingly, the contact body 59 repeats a sequential movement of contacting and then moving past the projection 551 of the elastic sheet 55.

Figure 20:
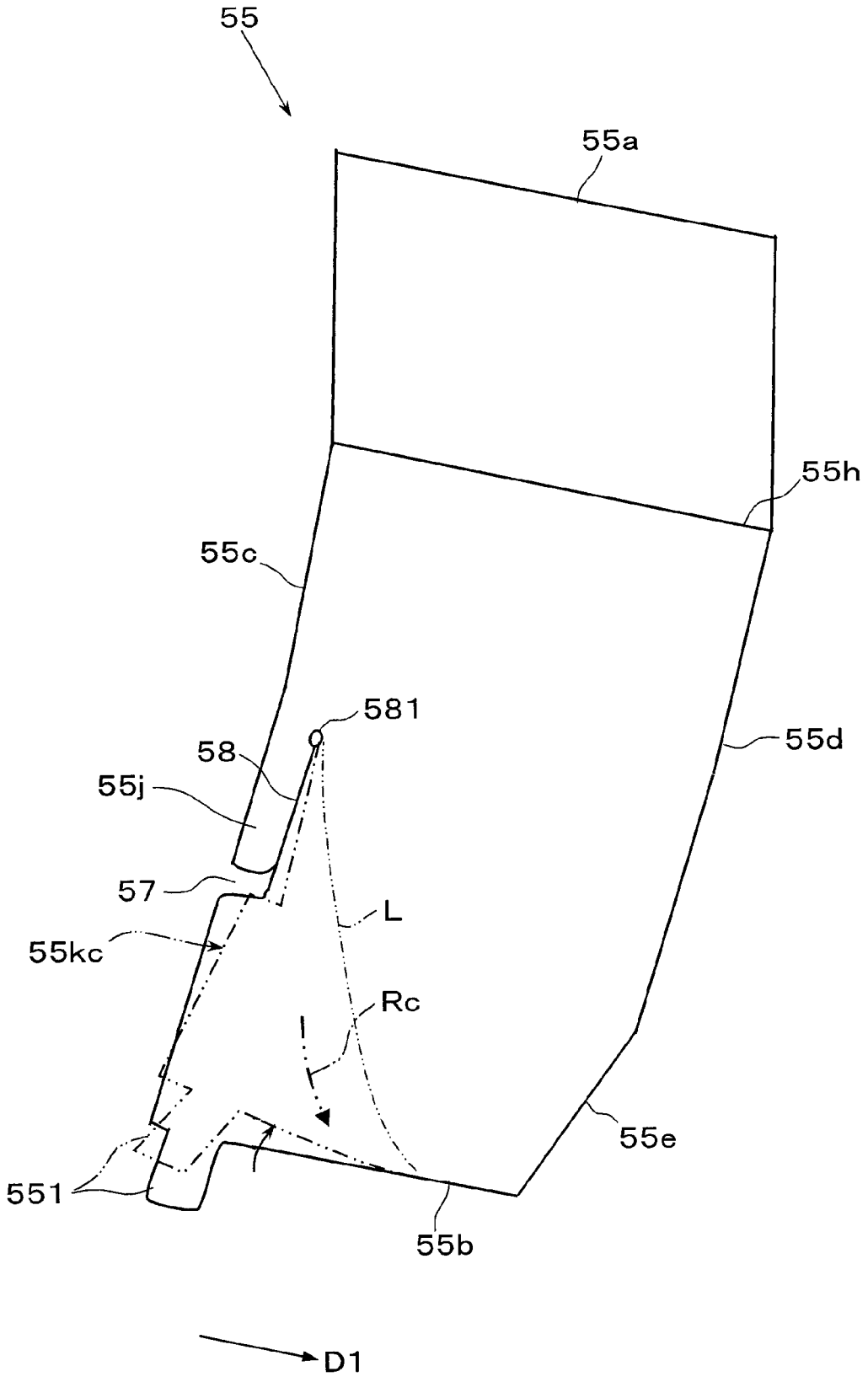
FIG. 20 is a schematic perspective view illustrating an elastic sheet disposed in the developer container illustrated in FIG. 19 and an example of the manner in which the elastic sheet is elastically deformed.

The projection 551 of the elastic sheet 55 of the developer transport device 5C is raised from below when the contact body 59 comes into contact therewith. Accordingly, as shown by the two-dot chain lines in FIG. 20, an upstream portion 55*kc* of the elastic sheet 55 in the transporting direction D1 is elastically deformed to be warped and bent obliquely upward and toward the downstream side in the transporting direction D1.

The portion 55*kc* of the elastic sheet 55 is elastically deformed in the above-described manner in a region having the first cut 57 and the second cut 58 at a boundary thereof. A portion 55*j* of the elastic sheet 55 that is surrounded by the upstream edge 55*c* in the transporting direction D1, the first cut 57, and the second cut 58 is hardly or only slightly elastically deformed, and is maintained in the vicinity of or substantially in contact with the inclined surface 52.

As a result, in the above-described developer container 61, before the toner 18At stored in the storage space unit 62 falls into the transport passage unit 53 connected to the bottom of the falling passage unit 51, the toner 18At is loosened by the movement of the portion 55*kc* of the elastic sheet 55 that is elastically deformed. In addition, the loosened toner 18At is moved downstream in the transporting direction D1, as shown by a two-dot-chain-line arrow Rc in FIG. 20, by the portion 55*kc* of the elastic sheet 55 that is elastically deformed.

Accordingly, even when the toner 18At may aggregate or has aggregated before falling into the transport passage unit 53, the toner 18At in such a state may be loosened by the movement of the portion 55*kc* of the elastic sheet 55. In addition, the loosened toner 18At may be moved downstream in the transporting direction D1.

In the above-described first modification, the elastic sheet 55 may be formed such that only the first cut 57 is provided and the second cut 58 is not provided.

When the elastic sheet 55 has only the first cut 57, compared to the case where the first cut 57 is not provided, the elastic sheet 55 may be more easily elastically deformed to be warped and bent toward the downstream side in the transporting direction D1. As a result, the loosened toner 18At may be easily moved downstream in the transporting direction D1.

Also in the above-described second modification, the elastic sheet 55 may be formed such that only the first cut 57 is provided and the second cut 58 is not provided.

When the elastic sheet 55 has only the first cut 57, compared to the case where the first cut 57 is not provided, the elastic sheet 55 may be more easily elastically deformed to be warped and bent toward the downstream side in the transporting direction D1. Also in this case, the loosened toner 18At may be easily moved downstream in the transporting direction D1.

Second Exemplary Embodiment

Figure 21:
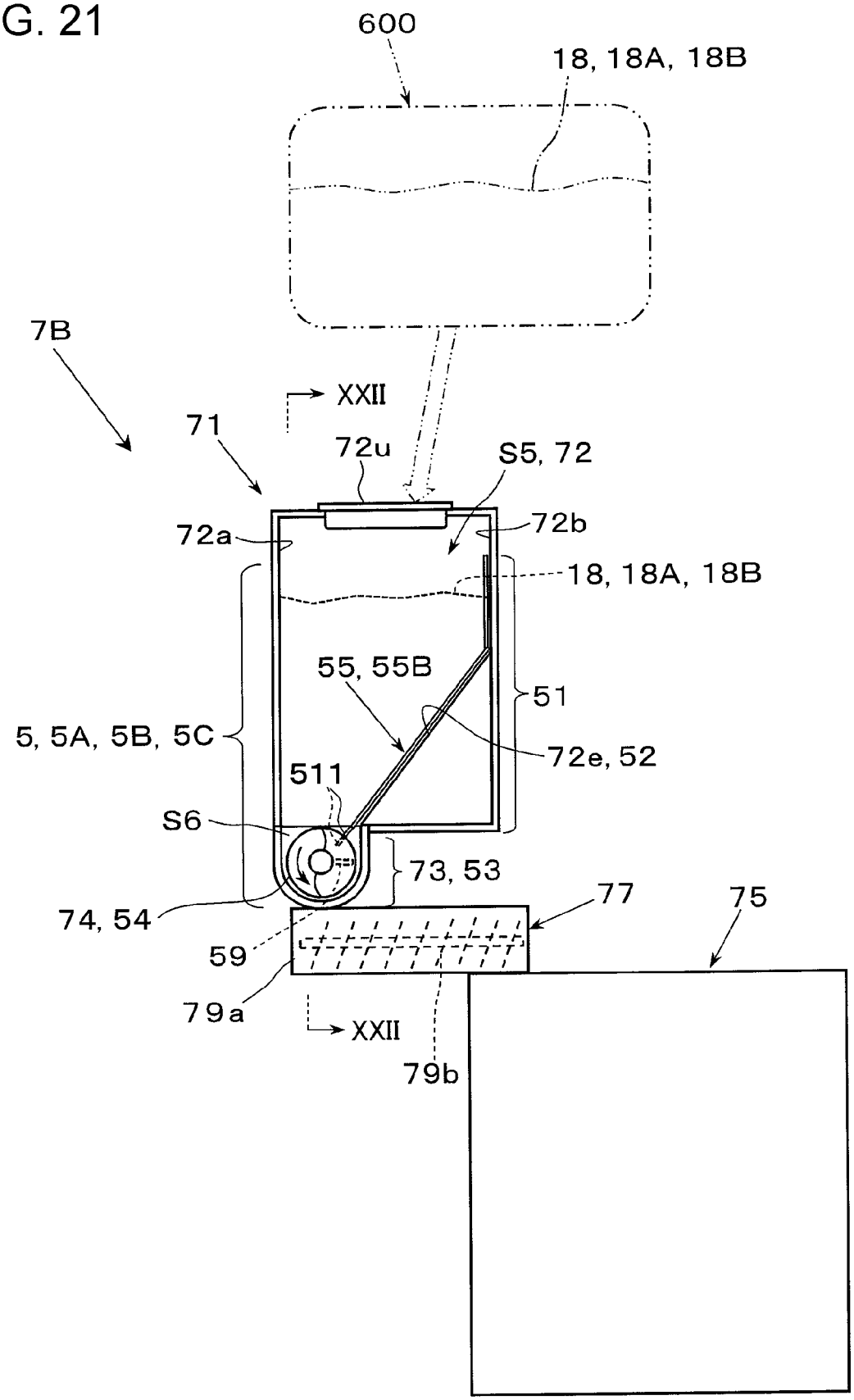
FIG. 21 is a schematic partially sectioned view of a powder supply device according to a second exemplary embodiment.

FIG. 21 illustrates a stationary powder supply device 7B as another example of the powder supply device 7 according to a second exemplary embodiment.

The powder supply device 7B includes a storage unit 71 in which powder 18 is stored, a receiving unit 75 that receives the powder 18 stored in the storage unit 71, and a supply transport unit 77 that transports and supplies the powder 18 stored in the storage unit 71 to the receiving unit 75.

The storage unit 71 is a fixed, non-replaceable structural part having a storage space unit 72 in which the powder 18 is stored.

The storage space unit 72 has an interior space S5 surrounded by four vertical surfaces 72*a*, 72*b*, 72*c*, and 72*d*, which are substantially orthogonal to each other and extend substantially vertically, and an inclined surface 72*e* provided below the vertical surface 72*b* and inclined so as to narrow the interior space S5 toward the bottom.

Figure 22:
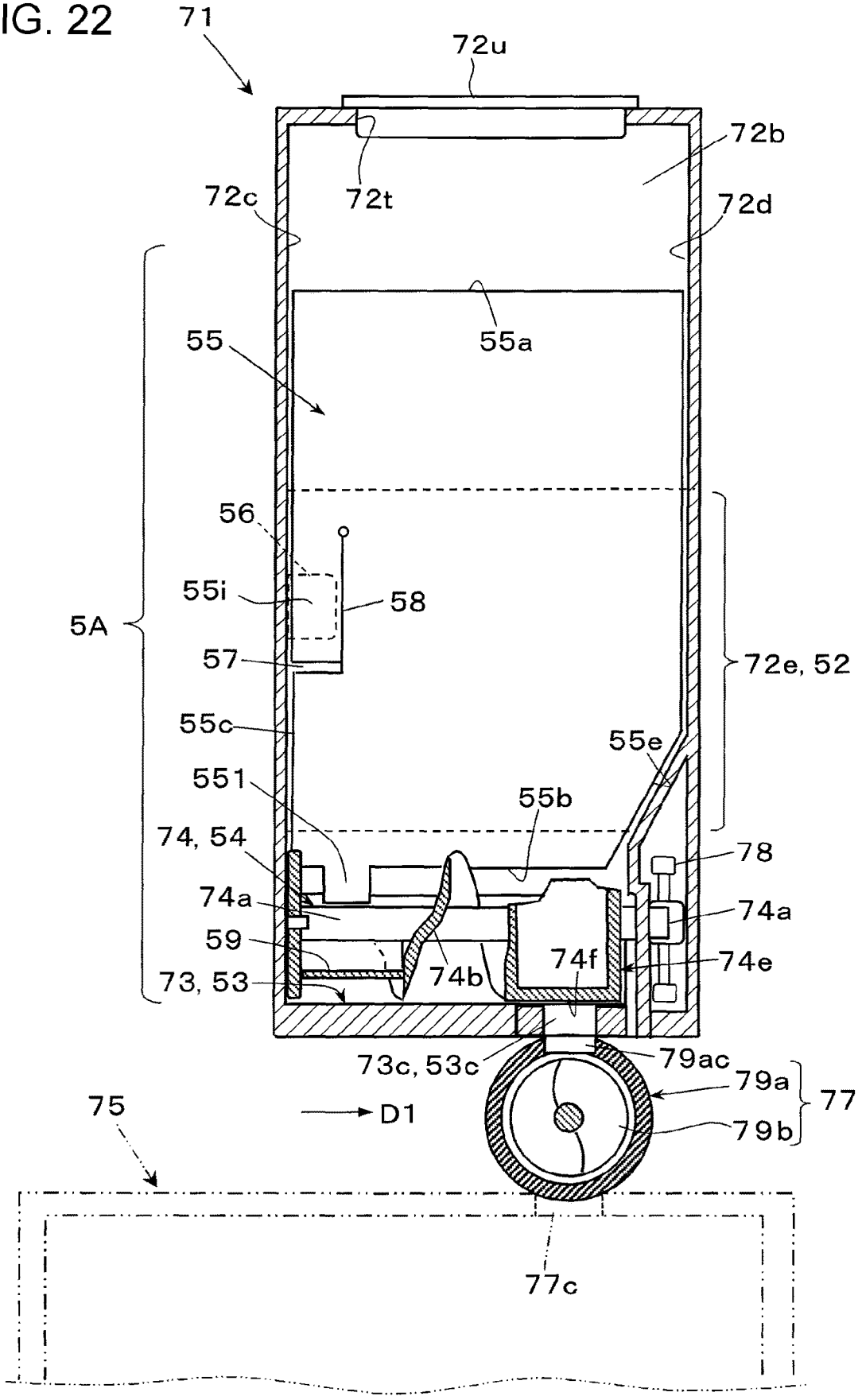
FIG. 22 is a schematic perspective view of a portion of a storage unit illustrated in FIG. 21 behind a cross-section taken along line XXII-XXII.

As illustrated in, for example, FIG. 22, the storage space unit 72 has a ceiling surface having an opening 72*t* at the upper end thereof. The opening 72*t* is basically used when the powder 18 is introduced, and is covered with a lid body 72*u* when not used.

The powder 18 may be, for example, the developer 18A (or toner 18At) described in the first exemplary embodiment or powder paint 18B.

As illustrated in FIGS. 21 and 22, the storage unit 71 includes a transport unit 73 connected to the bottom of the storage space unit 72 and having a passage space S6 that extends in the transporting direction D1 and through which the powder 18 is transported. A transport member 74 that rotates in the passage space S6 to move the powder 18 in the transporting direction D1 is disposed in the transport unit 73.

The transport unit 73 has, for example, substantially the same structure as that of the transport unit 63 (see FIGS. 7 to 9) of the container body 60 according to the first exemplary embodiment. Referring to FIG. 22, the transport unit 73 has a feed port 73*c* through which the powder 18 is fed.

The transport member 74 has, for example, substantially the same structure as that of the transport member 64 (see FIGS. 7 to 9) according to the first exemplary embodiment. Referring to FIG. 22, the transport member 74 includes a rotating shaft 74*a*, a transporting projection 74*b*, and a feeding portion 74*e*. The feeding portion 74*e* has an outer peripheral surface 74*f*, and a transmission gear 78 is attached to the rotating shaft 74*a*. The transmission gear 78 receives rotating power from a rotational driving device (not illustrated) when necessary.

The receiving unit 75 serves as a unit that uses and consumes the powder 18 supplied thereto. The receiving unit 75 may be, for example, a developing device when the powder 18 is the developer 18A or a powder-paint-applying device when the powder 18 is the powder paint 18B.

The receiving unit 75 is not limited to a unit that uses and consumes the powder 18 as described above, and may instead be, for example, a relay receiving unit that receives and temporarily stores the powder 18 fed and supplied thereto from the storage unit 71.

The supply transport unit 77 includes a transport tube 79*a* disposed to connect the storage unit 71 to the receiving unit 75; a transport member 79*b*, such as a screw auger, that rotates to transport the powder fed from the storage unit 71 to the receiving unit 75 through the transport tube 79*a*; and a driving device (not illustrated) that rotates the transport member 79*b*. The transport tube 79*a* has a receiving hole 79*ac* connected to the feed port 73*c* of the storage unit 71 and a discharge hole (not illustrated) connected to a receiving hole 77*c* in the receiving unit 75.

The storage unit 71 includes a powder transport device 5 that transports the powder 18 by causing the powder 18 to fall from the storage space unit 72, which has the above-described inclined surface 72*e* along which the powder 18 falls, into the transport unit 73.

Referring to FIGS. 21 and 22, the powder transport device 5 includes a falling passage unit 51, a transport passage unit 53, a transport member 54, and an elastic sheet 55. The falling passage unit 51 has an inclined surface 52 that is inclined so as to narrow the interior space S5, through which the powder 18 falls, in a lower region of the interior space S5. The transport passage unit 53 is connected to the bottom of the falling passage unit 51 and has the passage space S6 that extends in the transporting direction D1 in which the powder 18 is transported. The transport member 54 rotates in the passage space S2 of the transport passage unit 53 to transport the powder 18 in one direction, which is the transporting direction D1. The elastic sheet 55 is disposed to cover a portion of the storage space unit 72 including the inclined surface 52.

The above-described falling passage unit 51 of the powder transport device 5 is at least a portion of the storage space unit 72 of the storage unit 71 including the inclined surface 72*e* and a region around the inclined surface 72*e*. The above-described inclined surface 52 is the inclined surface 72*e* of the storage space unit 72. The above-described transport passage unit 53 is the transport unit 73 of the storage space unit 72. The above-described transport member 54 is the transport member 74 disposed in the transport unit 73 of the storage space unit 72.

As illustrated in FIGS. 21 and 22, the powder transport device 5 according to the second exemplary embodiment has a structure that is substantially similar to that of the developer transport device 5A according to the first exemplary embodiment (see, for example, FIGS. 7 to 9).

As illustrated in FIG. 22, in the powder transport device 5 according to the second exemplary embodiment, similarly to the developer transport device 5A, the elastic sheet 55 has the projection 551, the first cut 57, and the second cut 58. In addition, the contact body 59 is provided in the passage space S6 of the transport unit 73, and the protrusion 56 is provided on a portion of the inclined surface 52.

When it is required to supply the powder 18, the powder supply device 7B operates so that the powder transport device 5 is driven to transport and feed the powder 18 stored in the storage unit 71 to the supply transport unit 77 and that the supply transport unit 77 transports and supplies the powder 18 fed thereto to the receiving unit 75.

More specifically, when the powder supply device 7B is required to supply the powder 18, first, the transport member 54 of the powder transport device 5 is rotated in a predetermined direction for a predetermined time in the storage unit 71 by receiving rotating power transmitted from a rotational driving device (not illustrated) through the transmission gear 78.

Accordingly, in the storage unit 71, as illustrated in FIG. 21, the transport member 54, which is also the transport member 74, rotates in the predetermined direction in the passage space S6 of the transport passage unit 53, which is also the transport unit 73, to generate transporting force by which the powder 18 is moved and transported in the transporting direction D1.

The powder 18 that has been transported to the downstream end of the transport passage unit 53 in the transporting direction D1 is scooped by the recess in the feeding portion 74*e* of the transport member 54, and then falls through the feed port 53*c* in the transport passage unit 53 when the recess faces the feed port 53*c*. The powder 18 that has been fed is supplied to the transport tube 79*a* of the supply transport unit 77 through the receiving hole 79*ac*.

In the powder supply device 7B, the powder 18 fed from the storage unit 71 to the supply transport unit 77 is transported toward the receiving unit 75 by the transport member 79*b*, and is fed and supplied into the receiving unit 75 through the receiving hole 77*c* in the receiving unit 75.

In the storage unit 71, when the transport member 54 rotates in the passage space S6 of the transport passage unit 53 to supply the powder 18, the contact body 59 provided on the transport member 54 repeats a sequential movement of temporarily or periodically contacting the projection 551 of the elastic sheet 55 and then moving past the projection 551 of the elastic sheet 55.

When the contact body 59 comes into contact with the projection 551 of the elastic sheet 55 included in the powder transport device 5 of the storage unit 71, the projection 551 is gradually raised from below by the contact body 59 that moves together with the transport member 54 that rotates in the direction shown by the arrow. Accordingly, similarly to the elastic sheet 55 according to the first exemplary embodiment (see FIGS. 15 and 16), an upstream portion (55*k*) of the elastic sheet 55 in the transporting direction D1 is elastically deformed to be warped and bent obliquely upward and toward the downstream side in the transporting direction D1.

When the contact body 59 moves past the projection 551 after coming into contact therewith, the portion of the elastic sheet 55 that has been elastically deformed as described above is no longer raised by the contact body 59, and therefore returns to its original state.

Thus, when the contact body 59 repeatedly comes into contact with and moves past the projection 551, the portion of the elastic sheet 55 is repeatedly elastically deformed and restored from the elastically deformed state.

As a result, the powder 18 stored in the storage space unit 72 of the storage unit 71 is moved when the portion of the elastic sheet 55 of the powder transport device 5 is elastically deformed as described above.

Also in this powder supply device 7B, if, in particular, the powder 18 may aggregate or has aggregated before falling into the transport passage unit 53 at the bottom of the falling passage unit 51 having the inclined surface 52, which is inclined so as to narrow the interior space S5 of the storage space unit 72, the powder 18 in such a state may be loosened by the movement of the portion of the elastic sheet 55 that is elastically deformed.

In this case, since the portion of the elastic sheet 55 is elastically deformed to be warped and bent obliquely upward and toward the downstream side in the transporting direction D1 as described above, substantially similarly to the developer transport device 5A according to the first exemplary embodiment, the loosened powder 18 may be moved downstream in the transporting direction D1.

Thus, according to the elastic sheet 55 of the powder transport device 5, a portion thereof is elastically deformed in the above-described manner so that the powder 18 in the falling passage unit 51 is not simply loosened before the powder 18 falls into the transport passage unit 53, but may also be moved downstream in the transporting direction D1 of the transport passage unit 53. Thus, the elastic sheet 55 serves to assist the transportation of the powder 18 in the transporting direction D1 by the transport member 54 in the transport passage unit 53.

Thus, also in the powder supply device 7B, the elastic sheet 55 of the powder transport device 5 moves such that the powder 18 in the falling passage unit 51 of the storage unit 71 falls into the transport passage unit 53 at least without stopping due to aggregation and is reliably transported in the transporting direction D1. Then, the powder 18 is fed from the transport passage unit 53 to the supply transport unit 77, and supplied to the receiving unit 75 by the supply transport unit 77.

Accordingly, in the storage unit 71 including the powder transport device 5 and the powder supply device 7B including the storage unit 71, the powder 18 stored in the storage unit 71 may be smoothly fed from the storage space unit 72 of the storage unit 71 with small variations due to aggregation, and the amount of the powder 18 that remains in the storage space unit 72 due to aggregation may be reduced. Accordingly, the powder 18 stored in the storage unit 71 may be reliably supplied to the receiving unit 75.

Modification of Second Exemplary Embodiment

It is not necessary that the storage unit 71 be a unit having the powder 18 stored therein at the most upstream position along a passage through which the powder 18 is supplied, as described above. The storage unit 71 may instead be, for example, a relay storage unit that is disposed between another storage unit 600 disposed at the most upstream position, as shown by the two-dot chain lines in FIG. 21, and the receiving unit 75 and that receives and temporarily stores the powder 18 stored in the other storage unit 600 before the powder 18 is supplied to the receiving unit 75.

It is not necessary that a single storage unit 71 and a single receiving unit 75 be provided, and plural storage units 71 and plural receiving units 75 may instead be provided. When plural storage units 71 and plural receiving units 75 are provided, the powder transport device 5 is provided in each of the storage units 71.

In the powder supply device 7B according to the second exemplary embodiment, the powder transport device 5 may instead be a powder transport device (5B) having a structure substantially similar to the structure of the developer transport device 5B (see, for example, FIG. 17) according to the first modification of the first exemplary embodiment. In such a case, the powder transport device (5B) includes an elastic sheet 55B that does not have the first cut 57 or the second cut 58, as described above.

In addition, in the powder supply device 7B according to the second exemplary embodiment, the powder transport device 5 may instead be a powder transport device (5C) having a structure substantially similar to the structure of the developer transport device 5C (see, for example, FIG. 19) according to the second modification of the first exemplary embodiment. In such a case, the powder transport device (5C) does not include the protrusion 56 on the inclined surface 52, as described above.

Third Exemplary Embodiment

Figure 23:
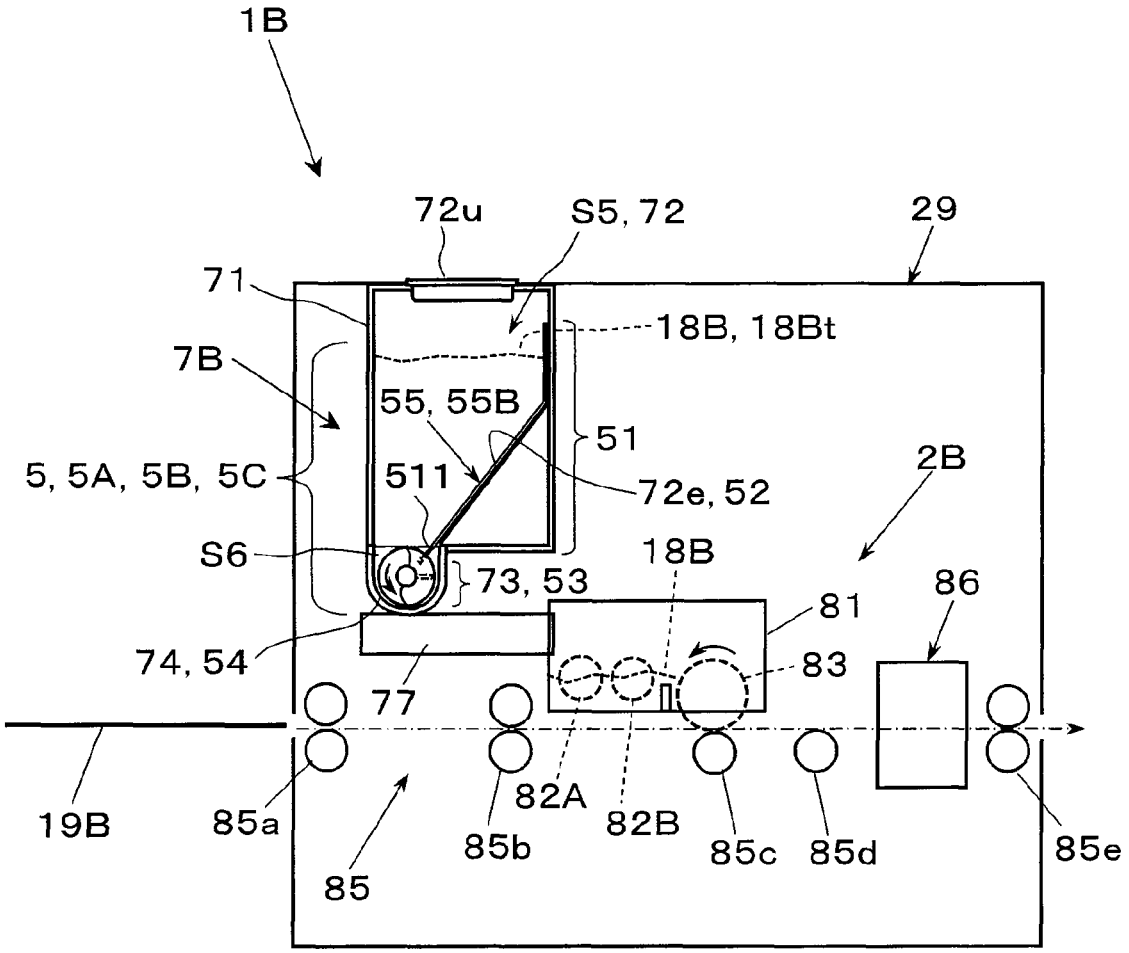
FIG. 23 is a schematic diagram illustrating a powder painting device according to a third exemplary embodiment.

FIG. 23 illustrates a powder painting device 1B as another example of a powder utilization apparatus 1 according to a third exemplary embodiment.

As illustrated in FIG. 23, the powder painting device 1B includes a storage unit 71 in which powder paint 18B, which is another example of the powder 18, is stored; a powder-paint-applying device 2B, which is another example of the powder consuming device 2 and which receives and consumes the powder paint 18B stored in the storage unit 71; and a powder supply device 7B that transports and supplies the powder paint 18B stored in the storage unit 71 to the powder-paint-applying device 2B.

The storage unit 71, the powder-paint-applying device 2B, and the powder supply device 7B are disposed in a housing 29. The housing 29 also houses a transport device 85 and a heating device 86. The transport device 85 transports a painting object 19B, which is another example of the sheet-shaped object 19 and which is subjected to powder painting, through the powder-paint-applying device 2B and the heating device 86. The heating device 86 heats the powder paint 18B applied to the painting object 19B by the powder-paint-applying device 2B to melt and solidify the powder paint 18B, so that the powder paint 18B is fixed to the painting object 19B. The painting object 19B may be a sheet, more specifically, a sheet-shaped conductive member made of, for example, metal, ceramic, or synthetic resin.

The powder-paint-applying device 2B includes a housing 81 having a storage chamber in which the powder paint 18B is stored. The housing 81 houses two stirring-and-transporting members 82A and 82B and an application roller 83. The stirring-and-transporting members 82A and 82B are, for example, screw augers that stir and transport the powder paint 18B in the storage chamber. The application roller 83 holds the powder paint 18B supplied by the stirring-and-transporting member 82B, transports the powder paint 18B to an application position at which the application roller 83 faces the painting object 19B, and applies the powder paint 18B to the painting object 19B.

The application roller 83 includes a cylindrical conductive holding-and-transporting body that rotates in a predetermined direction shown by the arrow, and a magnet member disposed in an interior space of the holding-and-transporting body. The holding-and-transporting body of the application roller 83 receives a voltage for electrostatically applying the powder paint 18B to the painting object 19B.

The powder paint 18B contains non-magnetic, thermosetting application powder 18Bt and magnetic carrier. The magnetic carrier is stored in the storage chamber of the housing 81 in advance. The application powder 18Bt of the powder paint 18B is stirred and transported by the stirring-and-transporting members 82A and 82B, and is thereby charged to a predetermined polarity by friction. Then, the application powder 18Bt adheres to the magnetic carrier forming chains on the outer peripheral surface of the holding-and-transporting body of the application roller 83, and is held in the form of a magnetic brush.

The powder paint 18B (application powder 18Bt contained therein) is consumed during powder painting, and is therefore fed from the powder supply device 7B to supply a deficiency.

The transport device 85 includes transport rollers 85*a*, 85*b*, and 85*e* provided in pairs and single transport rollers 85*c* and 85*d*. The transport device 85 transports the painting object 19B while grounding the painting object 19B. The transport device 85 may instead be, for example, a belt transport device.

The heating device 86 includes a heat source for heating the powder paint 18B on the painting object 19B. The heat source is disposed to face a layer of the application powder 18Bt on a painted surface of the painting object 19B that is transported. The heat source may be, for example, a known heat source such as a halogen lamp, a ceramic heater, or an infrared lamp. Another example of the heat source is a laser irradiation device that irradiates the application powder 18Bt with an infrared laser beam to heat the application powder 18Bt.

The powder supply device 7B transports and supplies the powder paint 18B (application powder 18Bt contained therein) stored in the storage unit 71 to the powder-paint-applying device 2B (storage chamber in the housing 81 thereof). In this example, the powder supply device 7B according to the second exemplary embodiment (FIGS. 21 and 22) is used.

Accordingly, as illustrated in FIG. 23, the powder supply device 7B includes the powder transport device 5 disposed in the storage unit 71. The powder transport device 5 may be the developer transport device 5A (see, for example, FIGS. 7 to 9) according to the first exemplary embodiment, but may instead be the developer transport device 5B (FIG. 17) according to the first modification of the first exemplary embodiment or the developer transport device 5C (FIG. 19) according to the second modification of the first exemplary embodiment.

The operation of the powder painting device 1B will now be described.

When the powder painting device 1B performs powder painting, the transport device 85 transports the painting object 19B so that the painting object 19B enters the housing 29 and passes through the application position of the powder-paint-applying device 2B. In the powder-paint-applying device 2B, the application roller 83 applies the powder paint 18B (application powder 18Bt contained therein) to one surface of the painting object 19B in the form of a layer.

Subsequently, the painting object 19B to which the powder paint 18B has been applied by the powder-paint-applying device 2B is transported through the heating device 86 by the transport device 85. The heating device 86 heats the powder paint 18B (application powder 18Bt contained therein) so that the powder paint 18B (application powder 18Bt contained therein) is thermally cured.

Thus, a paint film made of the powder paint 18B (application powder 18Bt contained therein) is formed on one surface of the painting object 19B, and the powder painting is completed. After the powder painting is completed, the painting object 19B is transported to the outside of the housing 29 by the transport device 85.

In the powder painting device 1B, when the powder paint 18B (application powder 18Bt contained therein) is supplied to the powder-paint-applying device 2B, the powder supply device 7B operates so that the powder paint 18B (application powder 18Bt contained therein) stored in the storage unit 71 is transported and supplied to the powder-paint-applying device 2B by the supply transport unit 77.

When the powder paint 18B (application powder 18Bt contained therein) is supplied, the powder transport device 5 disposed in the storage unit 71 of the powder supply device 7B is driven to transport and feed the powder paint 18B (application powder 18Bt contained therein) stored in the storage unit 71 to the supply transport unit 77.

Also in this powder supply device 7B, substantially similarly to the powder supply device 7B according to the second exemplary embodiment, the elastic sheet 55 of the powder transport device 5 moves such that the powder paint 18B in the falling passage unit 51 of the storage unit 71 falls into the transport passage unit 53 at least without stopping due to aggregation, and is reliably transported in the transporting direction D1 and fed from the transport passage unit 53 to the supply transport unit 77. Then, the powder paint 18B is supplied to the powder-paint-applying device 2B by the supply transport unit 77.

Accordingly, in the storage unit 71 including the powder transport device 5 and the powder supply device 7B including the storage unit 71, the powder paint 18B stored in the storage unit 71 may be smoothly fed from the storage space unit 72 of the storage unit 71 with small variations due to aggregation, and the amount of the powder paint 18B that remains in the storage space unit 72 due to aggregation may be reduced. Accordingly, the powder paint 18B stored in the storage unit 71 may be reliably supplied to the powder-paint-applying device 2B.

Other Modifications

In, for example, the first and third exemplary embodiments, the image forming apparatus 1A and the powder painting device 1B are described as examples of the powder utilization apparatus 1. However, when the powder transport device 5 (5A, 5B, or 5C) is effectively applicable to powder 18 other than the developer 18A or the powder paint 18B, the powder utilization apparatus 1 may instead be an apparatus that utilizes the other powder 18.

Although the image forming apparatus 1A includes four image forming devices 20 in the first exemplary embodiment, the image forming apparatus 1A may instead include a single image forming device 20, or three or five or more image forming devices 20. Also, the image forming apparatus 1A may instead be a direct transfer image forming apparatus.

In addition, in the powder painting device 1B, the stationary storage unit 71 may be replaced by a powder container 6 for the powder paint 18B (application powder 18Bt contained therein) that is removably attached to the housing 29 when used.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder transport device comprising:

a falling passage unit having an inclined surface that is inclined so as to narrow an interior space, through which powder falls, in a lower region of the interior space;

a transport passage unit that is connected to a lower end of the falling passage unit and that has a passage space that extends in a direction in which the powder is transported;

a transport member that rotates in the passage space of the transport passage unit to transport the powder in one direction, which is a transporting direction; and an elastic sheet that is disposed to cover a portion of the falling passage unit including the inclined surface, the elastic sheet including an upper end portion that is fixed and a lower end that serves as a free end and faces the transport member, wherein the elastic sheet includes a projection that extends and projects from the lower end at a position near an upstream end of the lower end in the transporting direction in which the powder is transported by the transport member, wherein the inclined surface has a protrusion that protrudes such that an upstream edge portion of the elastic sheet in the transporting direction is maintained separated from the inclined surface, and wherein a contact body is disposed in the passage space of the transport passage unit, the contact body repeating a movement of coming into contact with the projection to raise a portion of the elastic sheet and then moving away from the projection.

2. The powder transport device according to claim 1, wherein the protrusion is disposed upstream in the transporting direction relative to a center of the projection in the transporting direction.

3. The powder transport device according to claim 2, wherein the contact body is provided on an upstream portion of the transport member in the transporting direction.

4. The powder transport device according to claim 1, wherein the elastic sheet has a first cut that extends inward from an upstream edge of the elastic sheet in the transporting direction.

5. The powder transport device according to claim 4, wherein the elastic sheet has a second cut that extends from an end of the first cut toward an upper end of the elastic sheet.

6. The powder transport device according to claim 5, wherein the second cut in the elastic sheet extends in a direction that crosses the transporting direction.

7. The powder transport device according to claim 5, wherein the second cut is positioned downstream of the protrusion in the transporting direction.

8. The powder transport device according to claim 4, wherein the first cut has an end positioned within a range corresponding to a width of the projection of the elastic sheet in the transporting direction.

9. The powder transport device according to claim 4, wherein the elastic sheet has a second cut that extends from an end of the first cut toward an upper end of the elastic sheet, the second cut being positioned downstream of the protrusion in the transporting direction.

10. The powder transport device according to claim 4, wherein the contact body is provided on an upstream portion of the transport member in the transporting direction.

11. The powder transport device according to claim 1, wherein the contact body is provided on an upstream portion of the transport member in the transporting direction.

12. A powder container comprising:

a container body including:

a falling passage unit having an inclined surface that is inclined so as to narrow an interior space, through which powder falls, in a lower region of the interior space; and a transport passage unit that is connected to a lower end of the falling passage unit and that has a passage space that extends in a direction in which the powder is transported; and the powder transport device according to claim 1, the powder transport device transporting the powder in the container body by causing the powder to fall from the falling passage unit into the transport passage unit.

13. A powder utilization apparatus comprising:

a powder container in which powder is stored;

a powder consuming device that receives and consumes the powder stored in the powder container; and a supply transport unit that transports the powder stored in the powder container to supply the powder to the powder consuming device, wherein the powder container is the powder container according to claim 12.

14. A powder supply device comprising:

a storage unit for powder, the storage unit including:

a falling passage unit having an inclined surface that is inclined so as to narrow an interior space, through which the powder falls, in a lower region of the interior space; and a transport passage unit that is connected to a lower end of the falling passage unit and that has a passage space that extends in a direction in which the powder is transported;

a receiving unit that receives the powder stored in the storage unit;

a supply transport unit that transports the powder stored in the storage unit to supply the powder to the receiving unit; and the powder transport device according to claim 1, the powder transport device transporting the powder in the storage unit by causing the powder to fall from the falling passage unit into the transport passage unit.

15. A powder utilization apparatus comprising:

a storage unit in which powder is stored;

a powder consuming device that receives and consumes the powder stored in the storage unit; and a powder supply device that transports and supplies the powder stored in the storage unit to the powder consuming device, wherein the powder supply device is the powder supply device according to claim 14.

16. A powder transport device comprising:

a falling passage unit having an inclined surface that is inclined so as to narrow an interior space, through which powder falls, in a lower region of the interior space;

a transport passage unit that is connected to a lower end of the falling passage unit and that has a passage space that extends in a direction in which the powder is transported;

a transport member that rotates in the passage space of the transport passage unit to transport the powder in one direction, which is a transporting direction; and an elastic sheet that is disposed to cover a portion of the falling passage unit including the inclined surface, the elastic sheet including an upper end portion that is fixed and a lower end that serves as a free end and faces the transport member, wherein the elastic sheet includes a projection and has a first cut, the projection extending and projecting from the lower end at a position near an upstream end of the lower end in the transporting direction in which the powder is transported by the transport member, the first cut extending inward from an upstream edge of the elastic sheet in the transporting direction, and wherein a contact body is disposed in the passage space of the transport passage unit, the contact body repeating a movement of coming into contact with the projection to raise a portion of the elastic sheet and then moving away from the projection.

17. The powder transport device according to claim 16, wherein the elastic sheet has a second cut that extends from an end of the first cut toward an upper end of the elastic sheet.

18. The powder transport device according to claim 17, wherein the second cut in the elastic sheet extends in a direction that crosses the transporting direction.

19. The powder transport device according to claim 16, wherein the first cut has an end positioned within a range corresponding to a width of the projection of the elastic sheet in the transporting direction.

20. The powder transport device according to claim 16, wherein the contact body is provided on an upstream portion of the transport member in the transporting direction.

* * * * *